US005371580A

United States Patent [19]

Kato et al.

[11] Patent Number: 5,371,580

[45] Date of Patent: Dec. 6, 1994

[54] DOCUMENT FEEDING APPARATUS

[75] Inventors: Akio Kato, Toyokawa; Tomoyuki Atsumi, Toyohashi; Yoichi Kawabuchi; Hiroyuki Kishimoto, both of Toyokawa, all of Japan

[73] Assignee: Minolta Camera Kabushiki Kaisha, Osaka, Japan

[21] Appl. No.: 139,021

[22] Filed: Oct. 21, 1993

[30] Foreign Application Priority Data

Oct. 21, 1992 [JP] Japan ..... 4-283268

[51] Int. Cl.[5] ..... G03G 15/00

[52] U.S. Cl. ..... 355/320; 355/308; 355/318; 355/321; 355/23; 271/3; 271/7

[58] Field of Search ..... 355/308, 309, 318-321, 355/23, 24; 271/3, 4, 6, 7, 186

[56] References Cited

U.S. PATENT DOCUMENTS

| | | | |
|---|---|---|---|
| 4,052,054 | 10/1977 | Cardwell et al. . | |
| 4,595,273 | 6/1986 | Watanabe et al. . | |
| 4,727,401 | 2/1988 | Partilla et al. . | |
| 4,771,319 | 9/1988 | Hamakawa . | |
| 4,777,511 | 10/1988 | Takahashi | 355/23 X |
| 4,831,413 | 5/1989 | Hamakawa . | |
| 4,912,518 | 3/1990 | Matsuo et al. . | |
| 4,914,472 | 4/1990 | Hamakawa . | |
| 4,958,198 | 9/1990 | Hamakawa . | |
| 5,005,055 | 4/1991 | Matsuo et al. . | |
| 5,006,904 | 4/1991 | Matsuo et al. . | |
| 5,010,371 | 4/1991 | Matsuo et al. . | |
| 5,077,577 | 12/1991 | Hamakawa . | |
| 5,124,758 | 6/1992 | Hamakawa . | |
| 5,196,896 | 3/1993 | Hamakawa . | |
| 5,260,758 | 11/1993 | Stemmle | 355/321 |

FOREIGN PATENT DOCUMENTS

| | | |
|---|---|---|
| 60-2942 | 1/1985 | Japan . |
| 60-93463 | 5/1985 | Japan . |
| 61-196263 | 8/1986 | Japan . |

*Primary Examiner*—Matthew S. Smith

*Attorney, Agent, or Firm*—Burns, Doane, Swecker & Mathis

[57] ABSTRACT

A plurality of double-faced originals in a series of pages are stacked on a tray with a first page faced upward. An original transport mechanism is arranged to transport a first sheet of original fed by a feed roller to an exposure position through an intermediate waiting position on a platen glass for image exposure of a first page. Then, the original transport mechanism forwards the first sheet of original to a reverse/discharge roller provided downstream side of a transport belt to invert the surface and reverse side of the original. Thereafter, the original is returned to the intermediate waiting position by the transport belt.

Further, the original transport mechanism forwards a second sheet of original preliminarily fed to a position just before the transport belt to the exposure position by the transport belt side by side with the first sheet of original for an image exposure process without having a gap between second page of first original and third page of the second original to simultaneously expose images on one copy sheet. Thereafter, the original transport mechanism repeats the same procedures for a preceding original and a succeeding original to be fed preliminarily.

14 Claims, 19 Drawing Sheets

51
D2
D1
54
SE12
55
59a
58
56
D3
60
P
SE14
69
65
67
O
29
SE13

D1
D2
D3
65
66b
67
68
69
SE16
29
60
51

DOCUMENT FEEDING APPARATUS

BACKGROUND OF THE INVENTION

1. Technical Field of the Invention

The present invention relates to an automatic document feeding apparatus, and more particularly, to an automatic document feeding apparatus which is provided on an electrophotographic copying machine wherein an original is fed and transported onto a platen glass, and after the original is temporarily stopped for a copying operation at a predetermined position on the platen glass, the original is discharged.

2. Description of Related Art

In recent years, it has widely been practiced to construct a copying system which is combined with an automatic document feeding apparatus in an electrophotographic copying machine for the purpose of improving efficiency in a copying operation. In such a copying system, a two-in-one mode is developed.

In the two-in-one mode, two sheets of originals are forwarded to an exposure position on a platen glass side by side to simultaneously form images of the two sheets of originals on one copy sheet whereby the number of copy sheets can be reduced to half relative to the number of originals. Heretofore, however, the two-in-one mode could apply only to a single-faced original. For a double-faced original having images on both sides, the number of copy sheets to be used for a copying operation can be reduced by utilizing a double-faced copying function provided in the main body of a copying machine as compared with a case when a copying operation is performed on one side of a copy sheet. However, as for the number of copying procedures, a copying operation has to be performed corresponding to the number of pages, and the number of copy sheets can not be reduced to half.

SUMMARY OF THE INVENTION

A primary object of the present invention is to provide an automatic document feeding apparatus which is capable of placing a double-faced original at an exposure position on a platen glass without disturbing the order of pages under two-in-one mode.

These and other objects and features of the present invention will become more apparent from the following description taken in conjunction with the accompanying drawings which illustrated specific embodiment of the invention.

DESCRIPTION OF THE PREFERRED EMBODIMENTS

Description will be made hereinafter on an automatic document feeding apparatus which is applied to embodiments of the present invention referring to accompanying drawings.

First Embodiment; Refer to FIGS. 1 through 11 and FIG. 20

Figure 1:
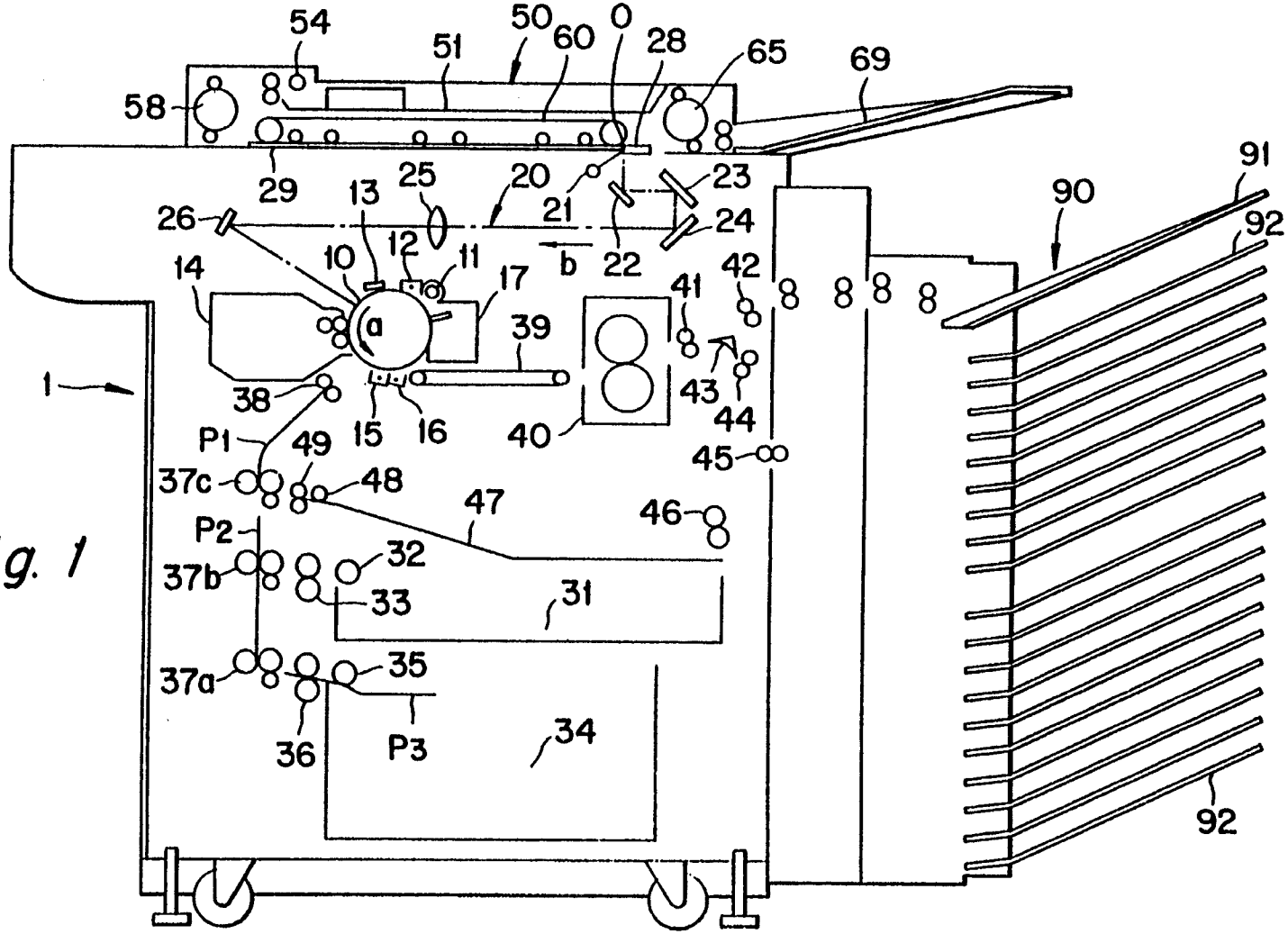
FIG. 1 is a schematic structural view showing an automatic document feeding apparatus (ADF) and the main body of a copying machine applied to a first embodiment of the present invention.

FIG. 1 shows an automatic document feeding apparatus 50 (hereinafter stated as ADF), the main body of a copying machine 1 and a sorter 90 in a first embodiment of the present invention.

Substantially at the center of the main body of a copying machine 1, there is provided a photoconductive drum 10 which is rotatably driven at a predetermined circumferential speed v in a direction of an arrow a. Around the photoconductive drum 10, there are disposed a main eraser 11, charger 12, suberaser 13, a magnetic brush-type developing unit 14, a transfer charger 15, a sheet separating charger 16 and a blade-type cleaner 17 along a rotating direction of the photoconductive drum 10. Furthermore, an optical system 20 is provided above the photoconductive drum 10.

The photoconductive drum 10 is provided with a sensitive layer on the surface thereof which is well known, and accompanied with a rotation toward a direction shown by the arrow a, electricity is charged and discharged by the main eraser 11, charger 12 and suberaser 13 to expose an image of an original placed on a platen glass 29 by the optical system 20. An electrostatic latent image which is formed on the photoconductive drum 10 by the exposure is made as a toner image by the developing unit 14.

The optical system 20 is provided immediately under the platen glass 29 to scan an image of an original placed on the platen glass 29 onto the photoconductive drum 10. More particularly, when the image is scanned, an exposure lamp 21 and a first mirror 22 are unitedly moved at a velocity of v/m (m: copying magnification) in a direction of an arrow b relative to a circumferential velocity v (irrespective of equal magnification or variable magnification) of the photoconductive drum 10. At the same time, a second mirror 23 and third mirror 24 are moved at a velocity of v/2m in a direction of the arrow b. Further, when a copying magnification is changed, a projection lens 25 is moved on an optical axis, and a fourth mirror 26 is swingably moved to rectify an optical path length.

Copy sheets are accommodated in an upper sheet feeding section 31 and a lower sheet feeding section 34, and the sheets are fed from either one of the sheet feeding sections one sheet by one sheet according to a selection made by an operator. In each one of the sheet feeding sections 31 and 34, there is provided a sheet feeding roller 32, 35, a separating roller 33, 36 comprised of a regular roller and a reverse roller. A sheet fed from the upper sheet feeding section 31 is forwarded to a timing roller 38 provided just in front of an image transfer section through transport rollers 37*b* and 37*c*. On the other hand, a sheet fed from the lower sheet feeding section 34 is forwarded to the timing roller 38 through transport rollers 37*a*, 37*b* and 37*c*.

Immediately above the upper sheet feeding section 31, an intermediate tray 47 is provided for conducting double-faced/composite copying processes. A sheet fed again from the intermediate tray 47 by a refeed roller 48 and separated by a separating roller 49 is forwarded to the timing roller 38 through the transport roller 37*c*.

The sheet forwarded to the timing roller 38 is temporarily stopped to stand by for the following process, and is further forwarded to a transfer section when the timing roller 38 is turned on simultaneously with an image formation on the photoconductive drum 10. The sheet is brought in close contact with the photoconductive drum 10 in the transfer section, and the toner image is transferred by an a.c. corona discharge from the transfer charger 15. The sheet is then separated from the photoconductive drum 10 by an a.c. corona discharge and inflexibility of the sheet itself. Thereafter, the sheet is transported into a fixing device 40 through a transport belt 39 for a fixing process, and is accommodated in the sorter 90 through transport rollers 41 and 42.

Meanwhile, the photoconductive drum 10 is kept rotating in a direction of the arrow a even after the transfer process to remove residual toner by the cleaner 17, and residual electric charge is erased by the main eraser 11 to be ready for the following copying operation.

In a composite copy mode, a sheet feeding direction of a sheet on which an image of odd-numbered original is transferred is changed by a changeover claw 43, and is forwarded onto the intermediate tray 47 through transport rollers 44, 45 and 46.

In a double-faced copy mode, a sheet is once transported to the entrance section to the sorter 90, and is then switched back with a reversing rotation of the transport roller 42. A feeding direction of the sheet is changed downward by the changeover claw 43, and the sheet is forwarded onto the intermediate tray 47 through the transport rollers 44, 45 and 46 as in the case of the composite copy mode mentioned above. Thereafter, the sheet is fed again from the intermediate tray 47 for copying an image of an even-numbered original for double-faced/composite copying operations.

In the meantime, a copying operation is started in the main body of a copying machine 1, and when a first sheet is temporarily kept just in front of the timing roller 38, a preliminary feeding process is conducted wherein not only a second sheet but also a third sheet is preliminarily forwarded to a sheet feeding path. In the case when a sheet is fed from the lower sheet feeding section 34, for instance, a second sheet P2 is fed to the sheet feeding path following a first sheet P1, and further, a third sheet P3 is fed to immediately in front of the transport roller 37*a*. Such a preliminary feeding process is conducted under not only a multiple copy mode but also a single copy mode where the ADF is utilized in order to speed up a copying operation.

The sorter 90 is provided with a non-sorting tray 91 and sorting trays comprised of 20 stages. Since this kind of sorter is well known, detailed description will be omitted.

Now, description will be made on the ADF50.

Figure 2:
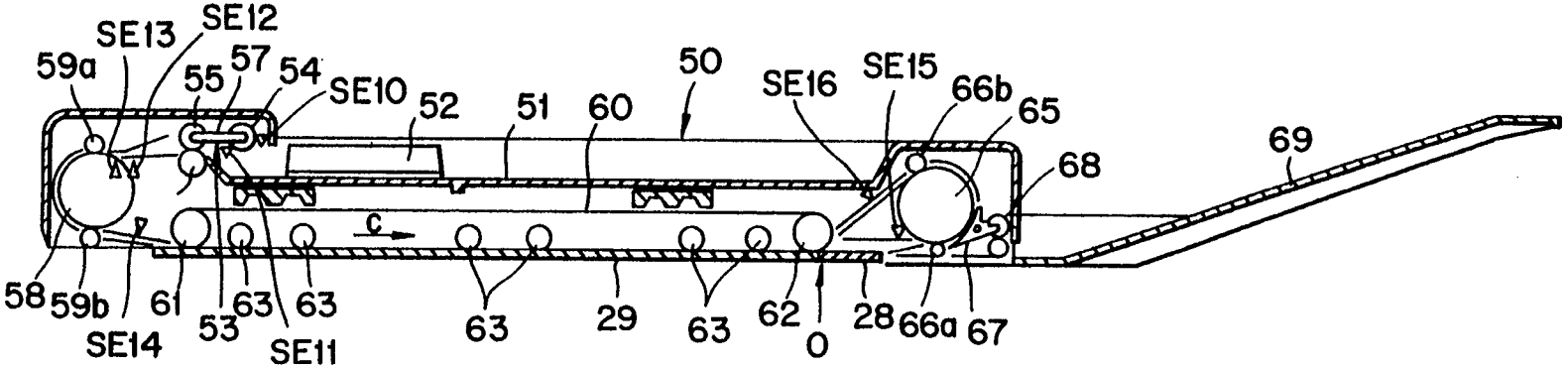
FIG. 2 is a cross-sectional view showing an internal structure of the ADF in the first embodiment of the present invention.

FIG. 2 shows a schematic structure of the ADF50 which is roughly comprised of an original tray 51, a pickup roller 54, a register roller 58, a transport belt 60, a reverse/discharge roller 65 and a discharge tray 69.

The ADF50 is disposed on the main body of a copying machine so as to position the transport belt 60 on the platen glass 29 which is openable by a metal hinge (not shown) provided at the back of the machine in order to manually set an original by an operator. The opening and closing of the ADF50 is detected by an unillustrated magnet sensor, and upon detection is made by the sensor that the ADF50 is properly closed, the ADF50 is able to start an operation.

The original tray 51 is provided with a pair of side regulating plates 52 and a leading end stopper 53. Originals are placed on the tray 51 with a first page faced upward. The leading end stopper 53 is swingably retracted downward from a regulating position when an original is fed. The pickup roller 54 is attached to the leading end of a rotatable lever 57 with a shaft of the regular separating roller 55 as a fulcrum, and is moved downward with the lever 57 when an original is fed to press the upper surface of the original. A reverse separating roller 56 elastically presses the regular separating roller 55 from below.

The register roller 58 is provided with pinch rollers 59*a* and 59*b* above and below thereof. The leading end of an original forwarded to the register roller 58 is once positioned at a nip section between the pinch roller 59*a*, and then, the original is transported to the entrance section to the platen glass 29 by inverting the original.

The transport belt 60 is endlessly stretched between a driving roller 62 and driven roller 61 so as to cover the whole surface of the platen glass 29. Inside the transport belt 60, a multiplicity of backup rollers 63 are rotatably disposed to bring the surface of the belt 60 in contact with the platen glass with a fixed pressure. Generally, the transport belt 60 is rotationally driven in the direction of an arrow c, and is stopped by adjusting the leading end of an original to an exposure standard point 0 which is a boundary line between a scale 28 and the platen glass 29.

Description will be made hereinafter on original feeding/transporting/stopping/discharging procedures.

For stopping an original at an exposure standard point 0, there are two methods, i.e. a scale mode and a pulse control mode. In the scale mode, the leading end of the scale 28 is projected from the surface of the platen glass 29, and the leading end of an original transported by the transport belt 60 is brought in contact with the scale 28 to forcibly stop the original. In the pulse control mode, the scale 28 is retracted to undersurface of the platen glass 29, and the amount of transport of an original is counted based on a rotational frequency of a driving motor to suspend the rotation of the transport belt 60 so as to stop the leading end of the original at an exposure standard point 0. In the present ADF50, the pulse control mode is adopted.

The reverse/discharge roller 65 is provided with pinch rollers 66*a* and 66*b* above and below thereof, and is further provided with a changeover claw 67 for the purpose of changing over a document feed path in order to invert a double-faced original around the reverse/-discharge roller 65. More particularly, when an original is inverted, the changeover claw 67 is positioned away from the surface of the roller 65 as illustrated in FIG. 2 to lead the original being discharged from the platen glass 29 toward the surface of outer periphery of the roller 65. The original is inverted around the roller 65, and is returned onto the platen glass 29 again. At this stage, the transport belt 60 is rotationally driven in a reverse direction of the arrow c. On the other hand, when an original is discharged, the leading end of the changeover claw 67 comes in contact with outer periphery of the reverse/discharge roller 65, and the original is discharged onto the tray 69 through a discharge roller 68 with a guide of the undersurface of the changeover claw 67.

Figure 4:
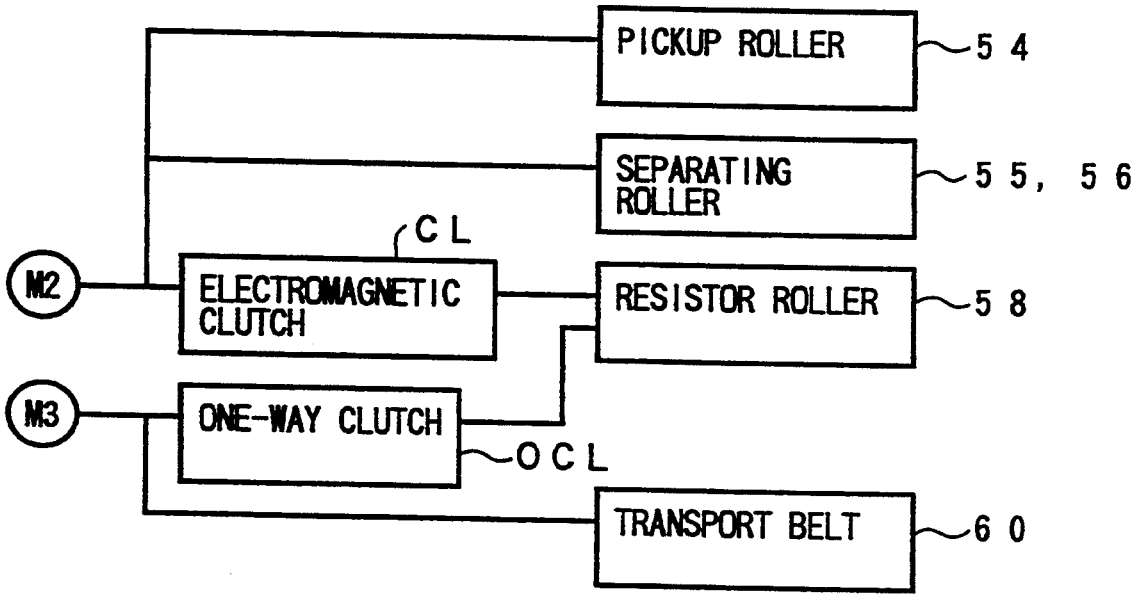
FIG. 4 is a block diagram showing a driving system in the ADF of the first embodiment of the present invention.
Figure 5:
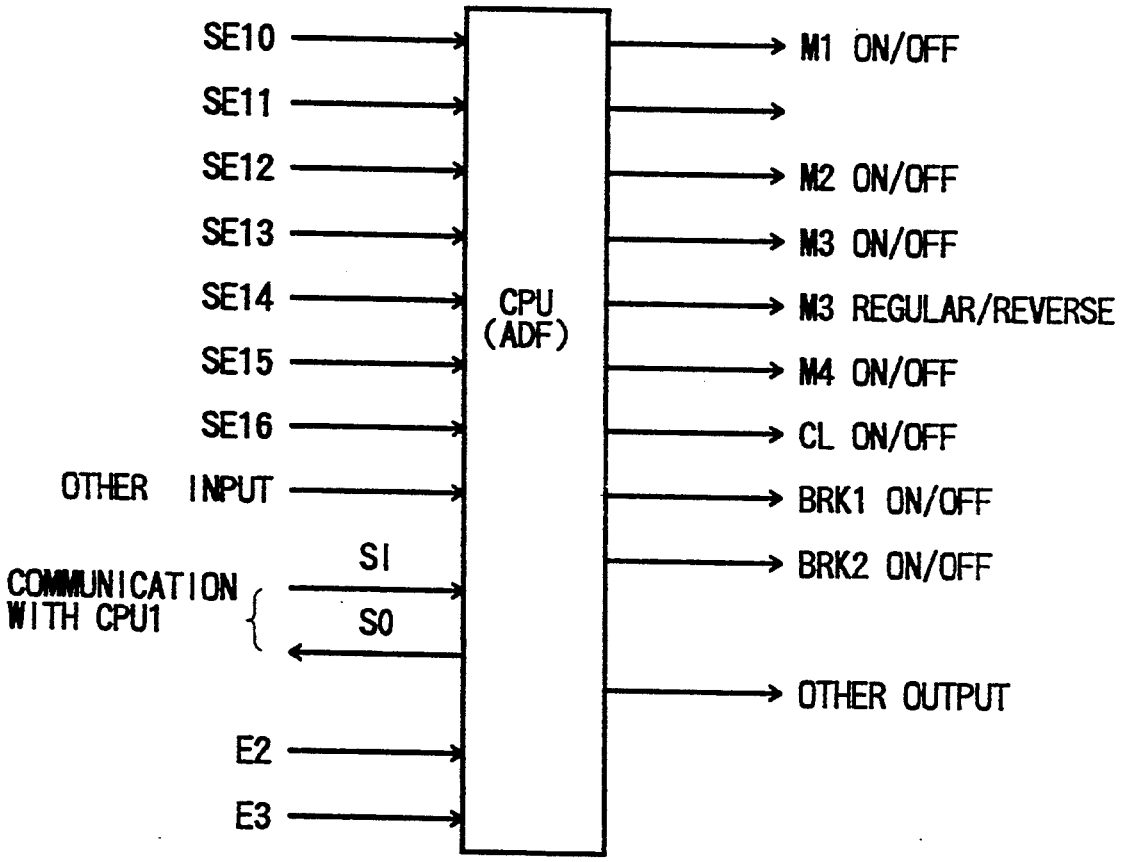
FIG. 5 is a block diagram showing a control circuit in the ADF of the first embodiment of the present invention.
Figures 6A, 6B, 6C, 6D:
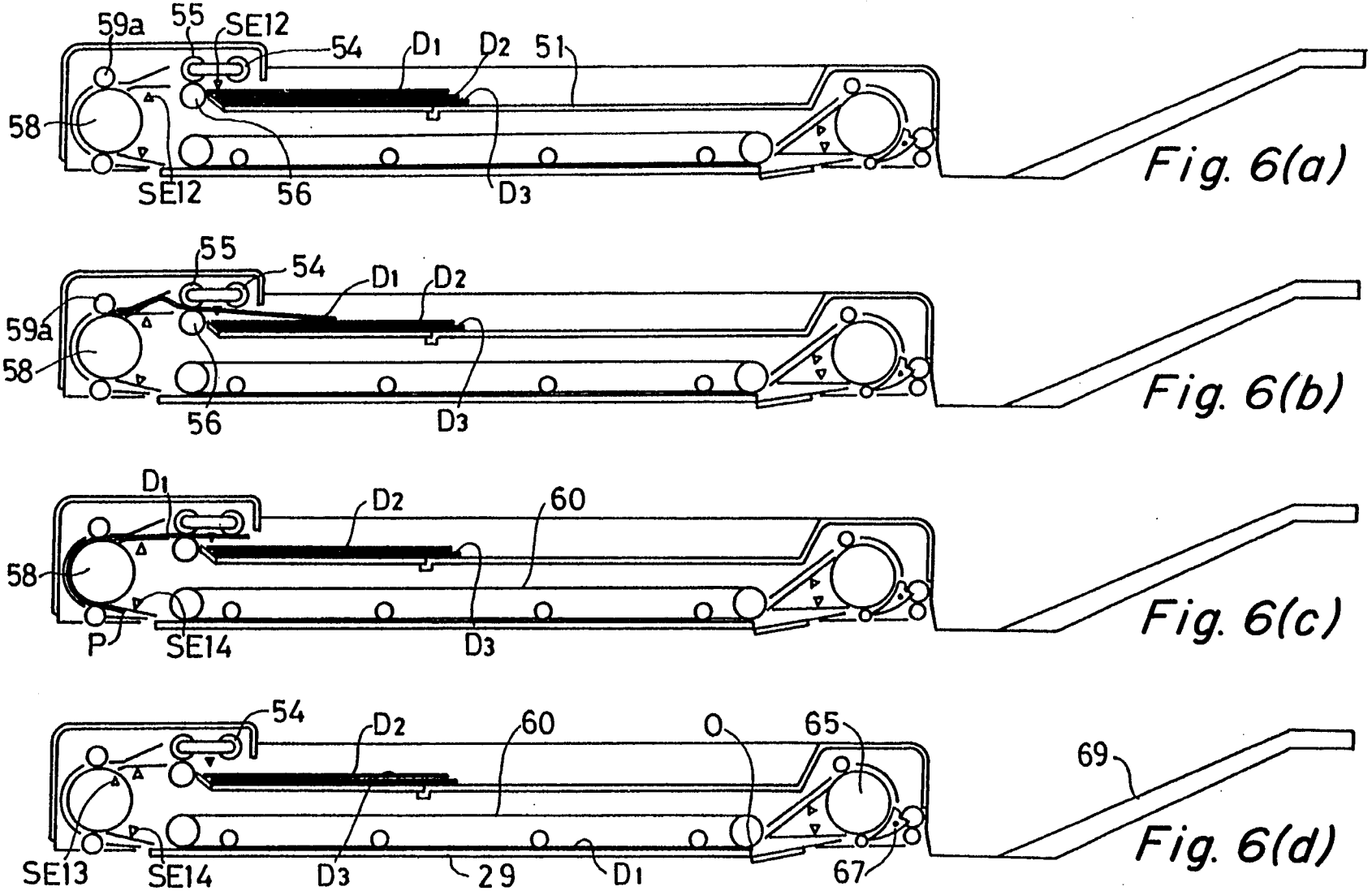
FIGS. 6(*a*)–6(*d*) are explanatory views showing how an original is transported in the ADF under a double-faced two-in-one mode.

The ADF50 is driven and controlled by various kinds of motors, clutches and sensors as shown in FIGS. 4 and 5. More particularly, the pickup roller 54 is elevated by a cam (not shown) which is rotationally driven by a pickup motor M1, and a descending position is detected by a pickup sensor SE10 which is turned on and off by a notch of the cam. As shown in the FIG. 4, the pickup roller 54 and separating rollers 55, 56, are rotationally driven by a feed motor M2, and the transport belt 60 is driven by a main motor M3 which can be rotated reversly. The reverse/discharge roller 65 and the discharge roller 68 are rotationally driven by a reverse/discharge motor M4. When an original is fed, the register roller 58 is rotationally driven by the feed motor M2 with turning on of an electromagnetic clutch CL. When an original is transported by the transport belt 60, the electromagnetic clutch CL is turned off, and the register roller 58 is rotationally driven by the main motor M3.

There is provided a one-way clutch OCL between the main motor M3 and register roller 58 to rotate the register roller 58 only when the roller is regularly rotated. It is arranged not to transmit a turning force when the register roller 58 is reversely rotated.

An electromagnetic brake BRK1 is attached to a shaft of the register roller 58, and an electromagnetic brake BRK2 is attached to a shaft of the driving roller 62 of the transport belt 60 respectively to prevent unnecessary rotation of the register roller 58 and transport belt 60.

To each one of the motors M2 and M3, encoders E2 and E3 which generate rotational pulse signal are attached respectively to detect rotational frequency of the motors, and the pulse signal is inputted into a microcomputer CPU which controls the ADF50. The pulse signal is utilized to detect the length of an original and to control a position where the original is stopped.

In the ADF50, the following original detecting sensors are provided. An empty sensor SE11 is disposed adjacent to the pickup roller 54 to detect existence of original on the tray 51. A register sensor SE12 is disposed just in front of the register roller 58 to detect an original forwarded from the tray 51. A width sensor SE13 is disposed at the side of the sensor SE12 to detect the size of an original in a lateral direction. A timing sensor SE14 is disposed at the entrance section to the platen glass 29 to function as a standard to control the transport of an original, and also to detect the length of the original. A discharge sensor SE15 detects an original being discharged from the platen glass 29, and a sensor SE16 detects an original inverted by the reverse/discharge roller 65.

Description will now be made on original feeding/-transporting/discharging procedures when a double-faced original is used in the ADF50 under two-in-one mode (refer to FIGS. 6 through 11 and FIG. 20).

A plurality of originals in page sequence are placed in the tray 51 with a first page faced upward, and when the presence of originals is detected by the empty sensor SE11, it becomes ready for a copying operation (original feeding action). When the two-in-one mode for a double-faced original is selected by an operator and a print key is pressed, the pickup motor M1 is turned on for a predetermined period of time to bring the pickup roller 54 down onto an original D1 (refer to in FIG. 6(*a*)).

After a predetermined period of time, the feed motor M2 is turned on to rotationally drive the rollers 54, 55, 56, and a first original D1 is separated into one sheet to be sent out of the separating rollers 55, 56. The leading end of the original is then brought in contact with a nip section between the register roller 58 and pinch roller 59*a*. When the leading end of the original is detected by the register sensor SE12, the electromagnetic brake BRK1 is turned on to lock the register roller 58 in order to prevent the register roller 58 from being driven by the contact with the leading end of the original D1. After a predetermined period of time since the leading of the original is detected by the sensor SE12, when a loop is formed at the leading end portion of the original D1 just in front of the register roller 58 (refer to FIG. 6(*b*)), the feed motor M2 is turned off whereby an oblique movement of the original D1 is rectified. Then, the pickup motor M1 is turned on for a predetermined period of time to bring the pickup roller 54 upward.

Then, simultaneously with a timing that the electromagnetic clutch CL is turned on, the electromagnetic brake BRK1 is turned off to start the feed motor M2 whereby the original D1 is transported by the register roller. Simultaneously with a timing that the feed motor M2 is turned on, the number of rotational pulses of the motor M2 emitted from the encoder E2 is counted, and the motor M2 is turned off at a time point that n1 pulses have been counted, and at the same time, the electromagnetic brake BRK1 is turned on to stop the register roller 58. Thereafter, the electromagnetic brake BRK1 and electromagnetic clutch CL are turned off. At this stage, a preliminary feeding process of a first original D1 is completed (refer to FIG. 6(*c*)), and the leading end of the original D1 is positioned at the entrance section to the platen glass 29, more particularly, at a position just in front of the timing sensor SE14 (a preliminary feeding standard point P of a first original) to stand by for the following process.

After the preliminary feeding process for the original D1 is completed as mentioned above, the main motor M3 is turned on for regular rotation. At this stage, the electromagnetic clutch CL is turned off, and the register roller 58 is rotationally driven together with the transport belt 60 to transport the original D1 onto the platen glass 29 with a first page of the original D1 faced downward to face the platen glass 29 (refer to FIG. 6(*d*)). During the transport, the number of rotational pulses of the main motor M3 emitted from the encoder E3 is counted simultaneously with a timing that the leading end of the original D1 is detected by the timing sensor SE14. When the rear end of the original D1 is detected by the sensor SE14, the pickup motor M1 is turned on for a predetermined period of time to bring down the pickup roller 54 to press an original D2 to be ready for the following feeding process.

In the present embodiment, when an original is transported onto the platen glass 29 from a preliminary feeding position, the register roller 58 and transport belt 60 are rotationally driven by the main motor M3. This is because if they are driven by their respective motors, it invites difficulties for synchronizing a drive starting timing and a velocity of original transport between the register roller 58 and transport belt 60 which requires a special control system for the synchronization. When their driving sources are arranged to be the same one for common use, such an inconvenience for the synchronization is avoided.

The length of an original in a direction of transport is detected by summing up the number of pulses from the encoder E2 counted during an original, is preliminarily fed and the number of pulses from the encoder E3 counted until the timing sensor SE14 is turned off (at a time of detection of the rear end of the original). The width of the original is detected by turning on and off the width sensor SE13, and the size of the original is finally judged. The platen glass 29 is provided with an area corresponding to the size of A3 sheet. If, therefore, the length of an original is less than 210 mm, it allows to execute the double-faced two-in-one mode. On the other hand, when the length of an original exceeds 210 mm, an ordinary double-faced normal mode is executed.

In the double-faced two-in-one mode, a first original D1 is stopped at an exposure position. After the rear end of the original D1 is detected by the sensor SE14, the main motor M3 is turned off at a time point that n7 pulses are counted from the encoder E3, and at the same time, the electromagnetic brake BRK2 is turned on to stop the transport belt 60. When the rotation of the transport belt 60 is stopped in such a manner, the leading end of the original D1 is stopped at an exposure position which is a standard exposure point 0 (refer to FIG. 6(*d*)). An image of the first original D1 which faces the platen glass is exposed hereat to reproduce a first page (the surface of D1) (refer to FIG. 20). An image ① of the first page is formed on the left half side of a copy sheet S1, and the right half side of the copy sheet is left blank.

Then, the original D1 is inverted to cause its second page to face the platen glass 29, and at the same time, a second original D2 is fed and placed at the exposure position with a third page facing the platen glass which was facing upward on the tray 51. The main motor M3 is then turned on, and at the same time, the changeover claw 67 is moved to a guide position which leads to an inverting path. The rever/discharge motor M4 is turned on after a predetermined time since the main motor M3 is started whereby the original D1 which is at the exposure position is transported around the reverse/discharge roller 65. When the leading end of the original D1 is detected by the reverse sensor SE16, the feed motor M2 is turned on to feed a second original D2 whose third page is facing upward from the tray 51 (refer to FIG. 7(*a*)).

On the other hand, at a time point that the leading end of the original D1 has passed through a nip section between the reverse/discharge roller 65 and the pinch roller 66*b*, the main motor M3 and reverse/discharge motor M4 are turned off to stop the transport of the original temporarily. Thereafter, the reverse/discharge motor M4 is turned on, and after the rear end of the original D1 has passed through the transport belt 60, the main motor M3 is rotated reversely whereby two sides of the original D1 is inverted, and under a state that the second page of the original faced the platen glass 29, the original is transported in the reverse direction of the arrow c on the platen glass 29 (refer to FIGS. 7(*b*) and 7(*c*)). At a time point that n8 pulses are counted from the encoder E3 after the rear end of the original D1 is detected by the reverse sensor SE16, the main motor M3 is turned off, and at the same time, the electromagnetic brake BRK2 is turned on to stop the transport belt 60. When the transport belt 60 is stopped in such a manner, the original D1 is stopped at an intermediate waiting position, more particularly, at a position where the end portion of the register roller 58 is positioned abutting the end portion of the platen glass 29 as illustrated in FIG. 3.

Figures 7A, 7B, 7C, 7D:
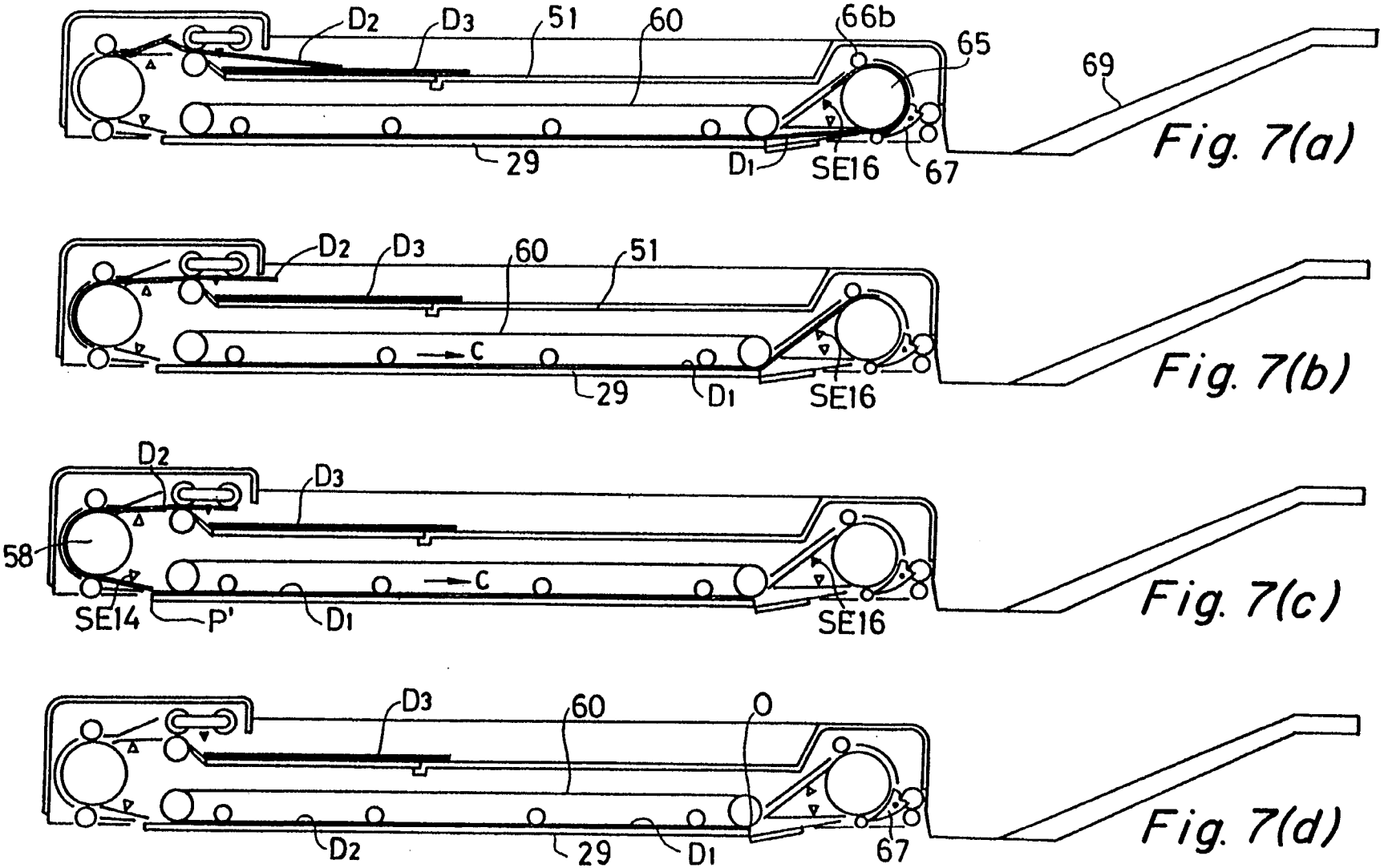
FIGS. 7(*a*)–7(*d*) are explanatory views is showing how an original is transported in the ADF under a double-faced two-in-one mode, continuation of FIG. 6.

A second original D2 is then fed to a preliminary feeding position (refer to FIG. 7(*c*)). The preliminary feeding process on and after second original is conducted fundamentally in the same manner as that of the first original D1 as described above wherein after the leading end of the original D2 is detected by the timing sensor SE12, the feed motor M2 is turned off at a time point that n6 pulses are counted from the encoder E2, and at the same time, the electromagnetic brake BRK1 is turned on to stop the register roller 58. Pulses n6 corresponds to an amount of transport from the time the original D2 is detected by the sensor SE14 to the time the original D2 is transported to the rear end (left side in the figure) stop position of the preceding original D1.

Accordingly, the leading end stop position P' of the original D2 (a preliminary feed standard position on and after second original) corresponds with the rear end position of the original D1 which is being stopped at an intermediate waiting position. With such a manner of transport procedure, a gap between the original D1 and original D2 becomes zero.

Figure 3:
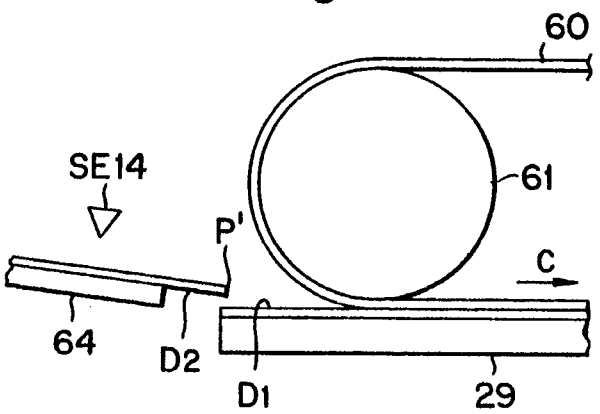
FIG. 3 is an explanatory view showing a state how an original is suspended at the entrance section to a platen glass.

As shown in the FIG. 3, the leading end of the original D2 which is preliminarily fed is projected a little from a lower guide plate 64, and is positioned immediately above the rear end of the original D1 which is positioned at the end portion of the platen glass 29. In order to make a gap between the originals zero, if the leading end of the original D2 is preliminarily fed to the point it corresponds with the rear end of the original D1 on the same plane, the original D2 may hit the original D1 to cause an oblique movement of either one of the originals D1 or D2. As arranged in the present embodiment, however, if there is provided a difference in level between the height of the rear end of the original D1 and the height of the leading end of the original D2, such a trouble of collision between the originals can surely be avoided.

Figure 20:
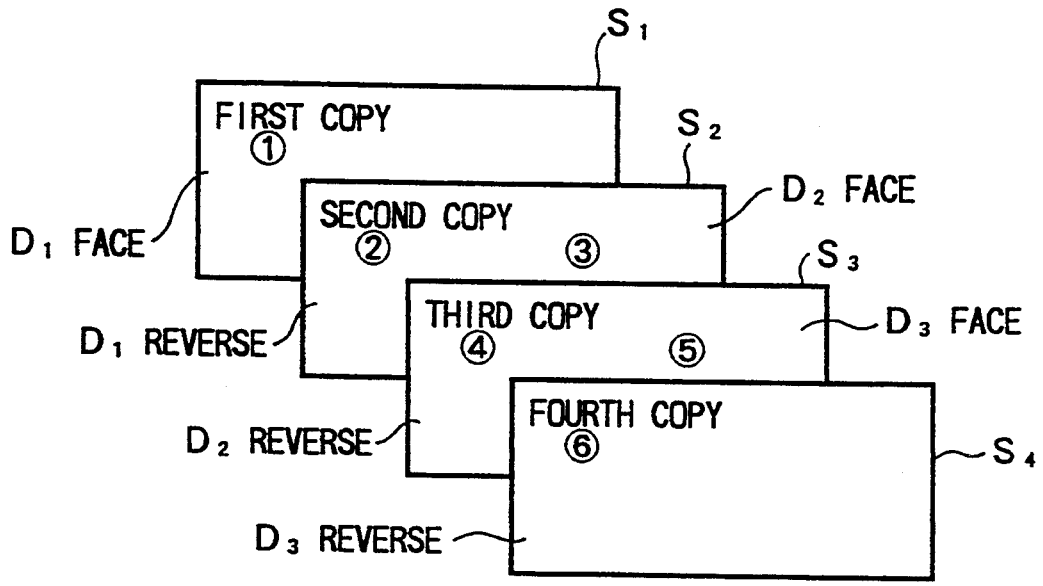
FIG. 20 is an explanatory view showing copy sheets reproduced under a double-faced two-in-one mode in the first embodiment of the present invention.

Then, originals D1 and D2 are transported to an exposure position where the leading end of the original D1 is positioned at an exposure standard point O. The main motor M3 is first turned on whereby the transport of the originals D1, D2 is started again, and a counting process for the number of pulses from the encoder E3 is started simultaneously with a timing that the motor M3 is turned on. At a time point that pulses n9 is counted from the encoder E3, the main motor M3 is turned off, and at the same time, the electromagnetic brake BRK2 is turned on to stop the transport belt 60 whereby the originals D1 and D2 are placed at the exposure position without having a gap therebetween (refer to FIG. 7(*d*)). At this stage, a second and (the reverse side of original D1) and a third page (the surface of original D2) are placed facing the platen glass 29. Image exposure process for the second and third pages are conducted at this stage, and image ② and ③ of the second and third pages are formed on a second copy sheet S2 as illustrated in FIG. 20.

After the image exposure process, reverse/discharging processes of the original D1, reverse/reverse transporting processes of the original D2, a feeding process of an original D3 and placement of the originals D2 and D3 at the exposure position are conducted successively. The main motor M3 is first turned on, and at the same time, the changeover claw 67 is moved to the guide position which leads to the inverting path. After a predetermined period of time since the main motor M3 is turned on, the reverse/discharge motor M4 is turned on whereby the original D1 positioned at the exposure position is transported to the periphery of the reverse/-discharge roller 65 (refer to FIG. 8(*a*)).

After a time point that the leading end of the original D1 has passed through a nip section between the reverse/discharge roller 65 and pinch roller 66*b*, the motors M3 and M4 are turned off to temporarily stop the transport of the original D1. Then, the reverse/discharge motor M4 is turned on, and after a time point that the rear end of the original D1 has passed through the transport belt 60, the main motor M3 is rotated reversely whereby the originals D2 and D1 are transported in a reverse direction of the arrow c on the platen glass 29. At this stage, the first page of the original D1 faces the platen glass 29 (refer to FIG. 8(*b*)).

In this case, after the rear end of the original D1 is detected by the reverse sensor SE16, the main motor M3 is turned off at a time point that pulses n10 are counted from the encoder E3, and at the same time, the electromagnetic brake BRK2 is turned on to stop the transport belt 60. At this stage, the original D1 is returned substantially to the exposure position passing through the inverting section, and the original D2 is positioned at the left side in the figure on the platen glass 29. Then, the main motor M3 is turned on, and the reverse/discharge motor M4 is turned on after a predetermined period of time. The changeover claw 67 is already changed over to the guide position which leads to the tray 69. A discharging process for the first original D1 is started, and when the original D1 has passed through the transport belt 60, the main motor M3 is turned off. Thereafter, the original D1 is discharged onto the tray 69 with the first page faced downward accompanying with the rotation of the reverse/discharge roller 65 and the discharge roller 68 (refer to FIG. 8(*c*)).

Figures 8A, 8B, 8C, 8D:
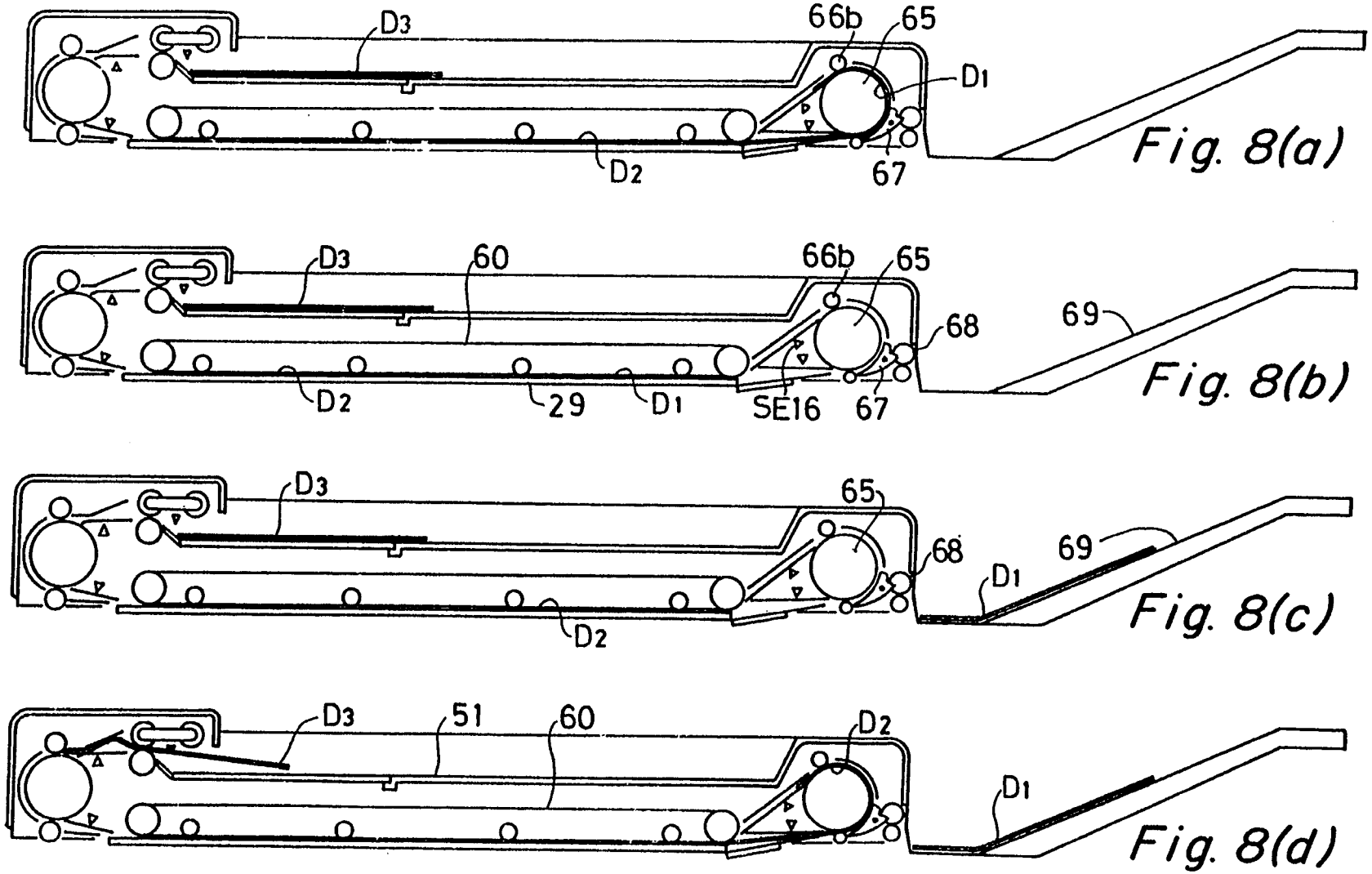
FIGS. 8(*a*)–8(*d*) are explanatory views showing how an original is transported in the ADF under a double-faced two-in-one mode, continuation of FIG. 7.
Figures 9A, 9B, 9C, 9D:
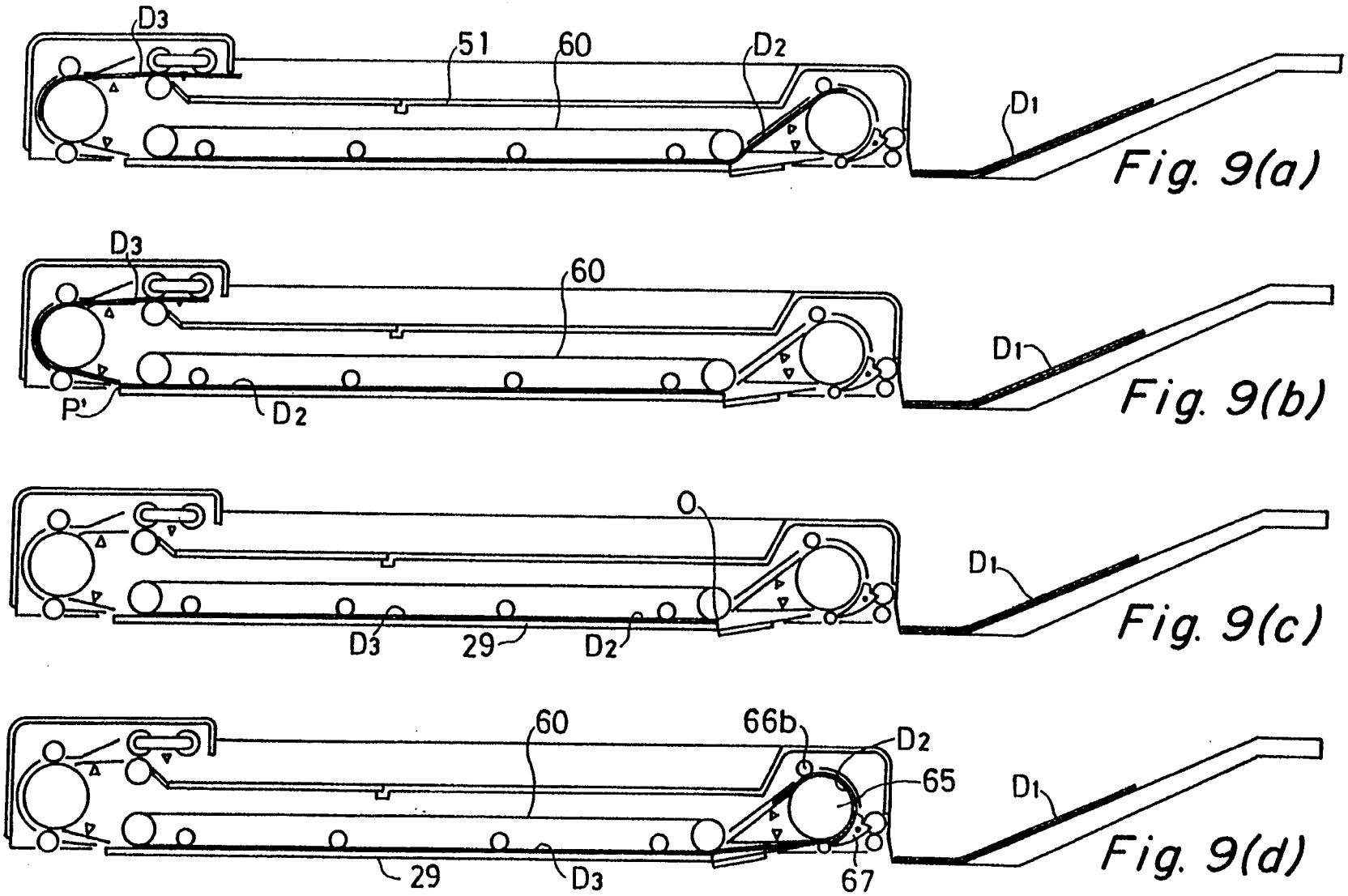
FIGS. 9(*a*)–9(*d*)are explanatory views showing how an original is transported in the ADF under a double-faced two-in-one mode, continuation of FIG. 8.

After the completion of the discharge process of the original D1, a second original D2 is inverted, and the transport belt 60 is rotated reversely to stop the original D2 at an intermediate waiting position (refer to FIG. 8(*d*) and FIGS. 9(*a*) and 9(*b*)). A process which is taken at this stage is the same as the process taken for the first original D1 wherein the original D1 has been inverted and placed at the intermediate waiting position as described above. Accompanied with this process, a third original D3 is preliminarily fed from the tray 51, and the original is stopped at a time point when the leading end of the original is reached a preliminary feed standard point P' (refer to FIG. 9(*b*)). The rear end of the original D2 which is at the intermediate waiting position and the leading end of the original D3 which is fed preliminarily corresponds each other having a difference in level between the originals as stated above.

Then, the main motor M3 is turned on to transport the originals D2, D3, on the platen glass 29, and the transport belt 60 is stopped at a point of time that the leading end of the original D2 has reached the exposure standard point O whereby the originals D2 and D3 are placed at the exposure position without having a gap therebetween (refer to FIG. 9(*c*)). At this stage, fourth page (the reverse side of the original D2) and fifth page (the surface of the original D3) are placed facing the platen glass 29. An image exposure process is conducted hereat, and images of ④ and ⑤ of the fourth and fifth pages are reproduced on a third copy sheet S3 as illustrated in FIG. 20.

After the completion of the image exposure process for the reverse side of the original D2 and the face side of the original D3, reverse/discharge process for the original D2 and reversing process for the original D3 are conducted successively to place the original D3 at the exposure position. The reverse/discharge process for the original D2 is the same as the process which is taken for the original D1 stated above. More particularly, the main motor M3 is turned on to set the changeover claw 67, and the reverse/discharge motor M4 is turned on to transport the original D2 around the reverse/discharge roller 65 (refer to FIG. 9(*d*)). The motors M3 and M4 are turned off temporarily after the leading end of the original D2 has passed through a nip section between the rollers 65 and 66*b*, and after the rear end of the original D2 has passed through the transport belt 60, the motor M3 is rotated reversely. At a time point that pulses n10 is counted after the rear end of the original D2 has been detected by the reverse sensor SE16, the transport belt 60 is stopped. At this stage, the original D2 is returned to the exposure position passing through the inverting section, and the original D3 is positioned on the right side in the figure of the platen glass 29 (refer to FIG. 10(*a*)).

Then, the main motor M3 is turned on with the changeover claw 67 returned to the guide position which leads to the tray 69, and reverse/discharge motor M4 is turned on. After the original D2 has passed through the transport belt 60, the main motor M3 is turned off, and accompanied with the rotation of the rollers 65 and 68, the original D2 is discharged onto the tray 69 with the third page faced downward (refer to FIG. 10(*b*)). The originals D1, D2, . . . successively discharged onto the tray 69 are placed with their surfaces faced downward.

Figures 10A, 10B, 10C, 10D:
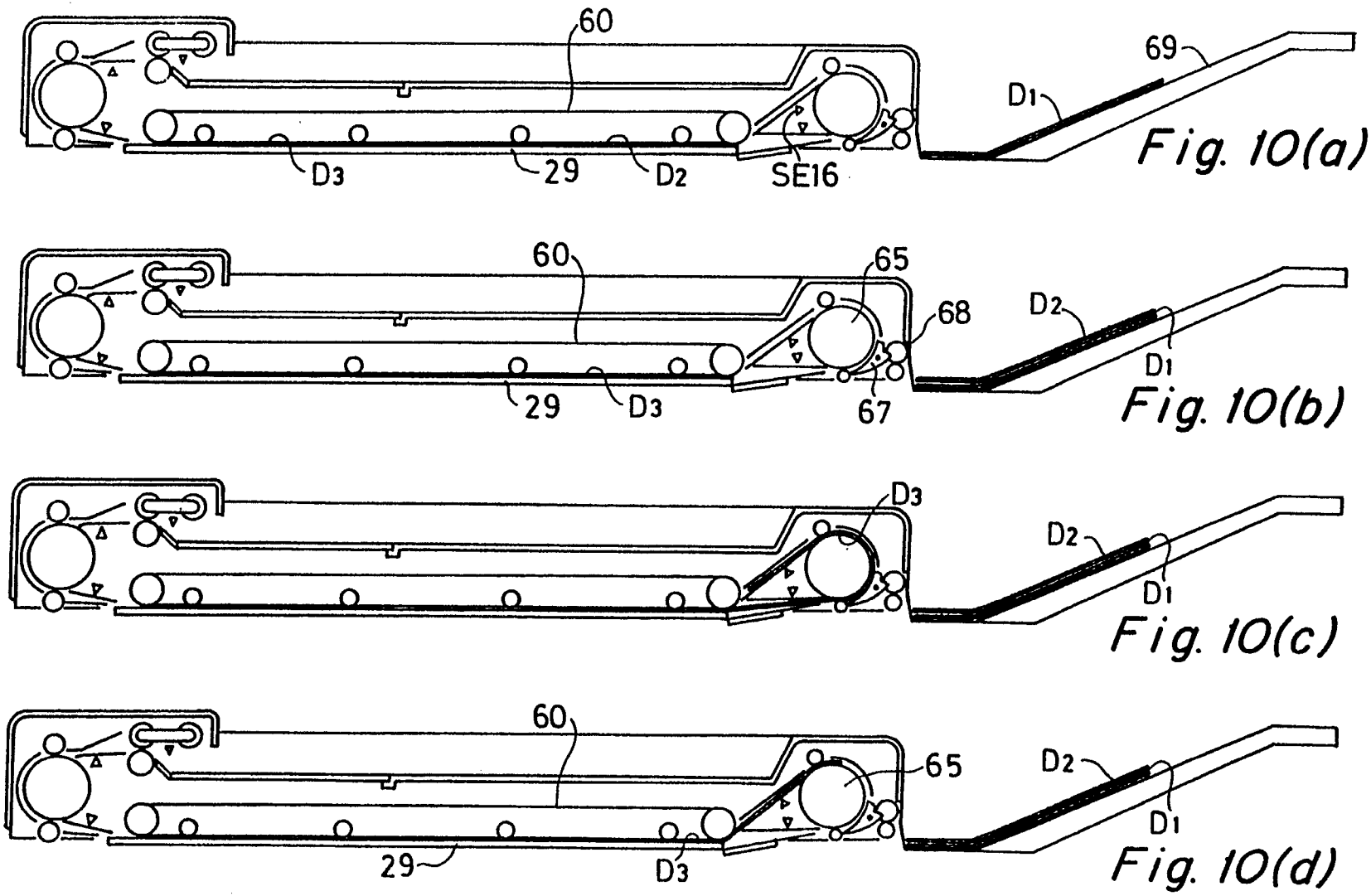
FIGS. 10(*a*)–10(*d*) are explanatory views showing how an original is transported in the ADF under a double-faced two-in-one mode, continuation of FIG. 9.

Thereafter, the third original D3 is inverted (refer to FIGS. 10(*c*) and 10(*d*)), and at a time point that pulses n11 is counted after the rear end of the original D3 is detected by the reverse sensor SE16, the transport belt 60 is stopped. At this stage, the rear end of the original D3 is positioned and stopped at the exposure standard point 0 with its reverse side faced downward (refer to FIG. 11(*a*)). An image ⑥ of sixth page is then reproduced on a fourth copy sheet S4 as illustrated in FIG. 20. The image ⑥ is formed on the left half side of the copy sheet S4, and the right half side is left blank.

Figure 11A:
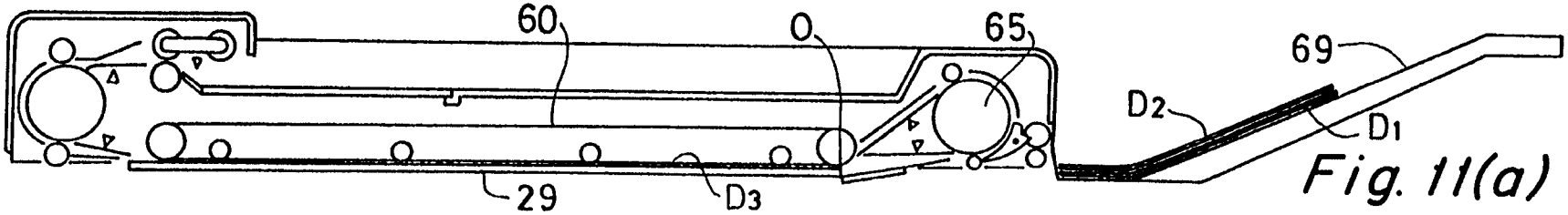
FIGS. 11(*a*)–11(*b*) are explanatory views showing how an original is transported in the ADF under a double-faced tow-in-one mode, continuation of FIG. 10.
Figure 11B:
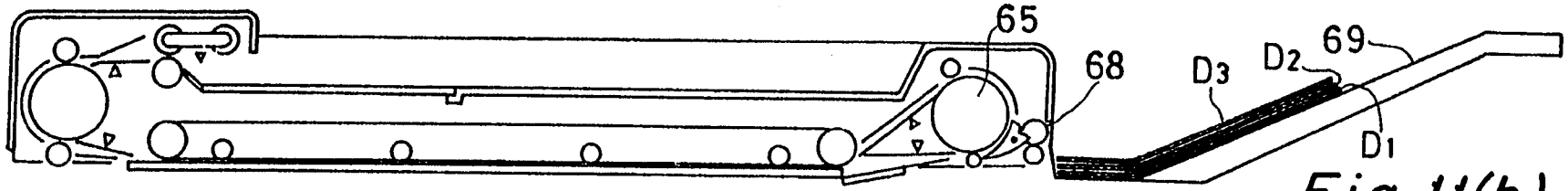
Figure 12:
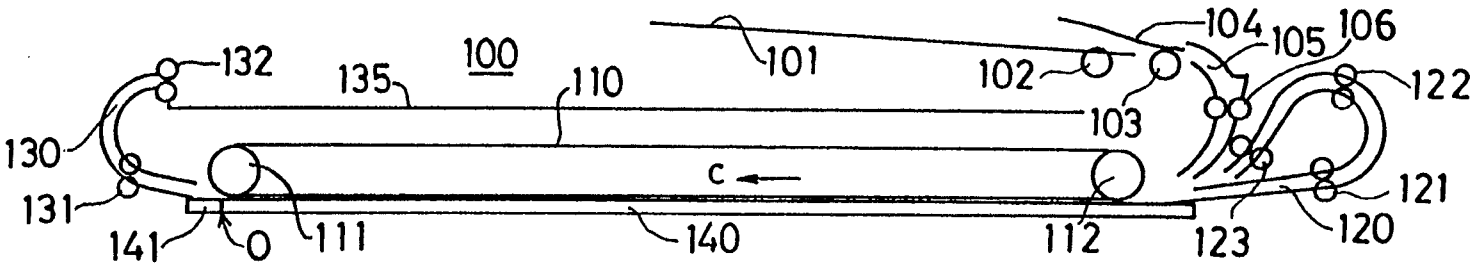
FIG. 12 is a schematic structural view showing an automatic document feeding apparatus (ADF) in a second embodiment of the present invention.
Figure 13A:
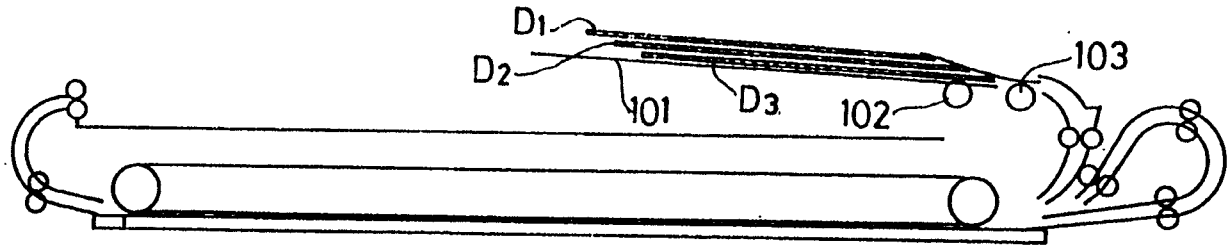
FIGS. 13(*a*)–13(*d*) are explanatory views showing how an original is transported in the ADF in the second embodiment of the present invention under a double-faced two-in-one mode.
Figure 13B:
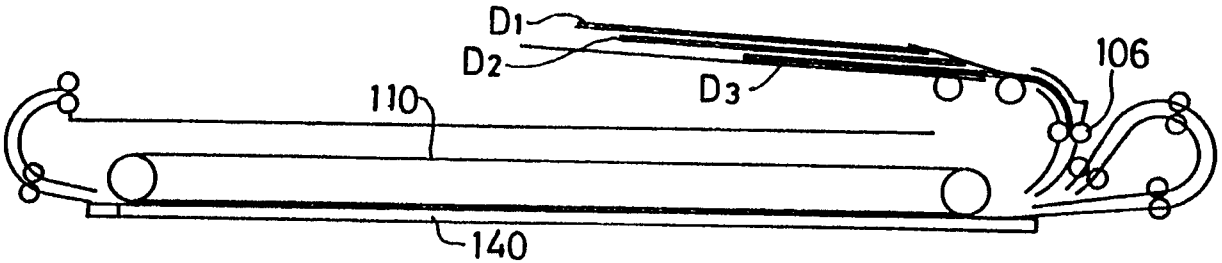
Figure 13C:
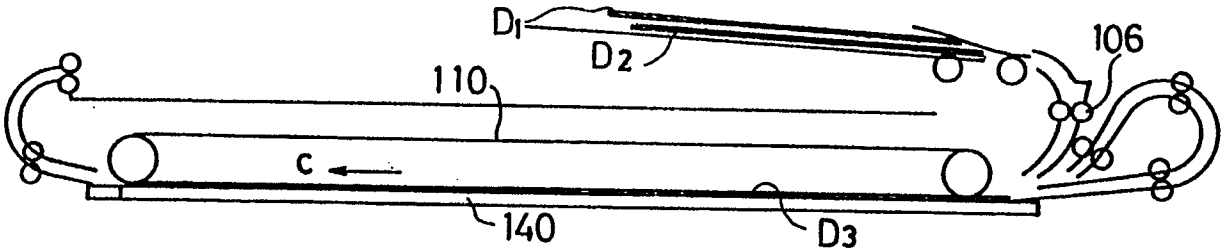
Figure 13D:
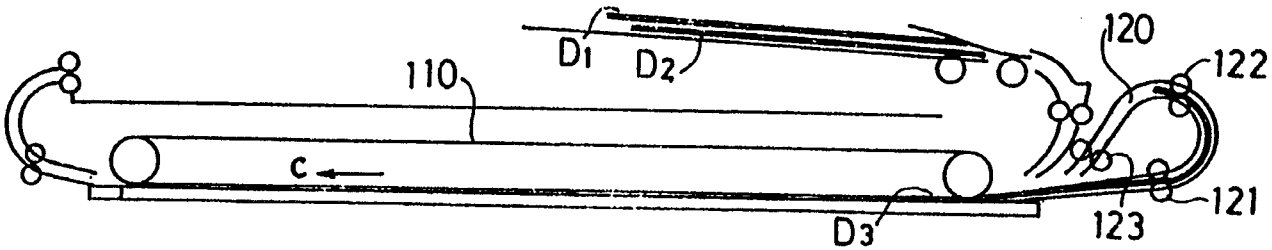
Figure 14A:
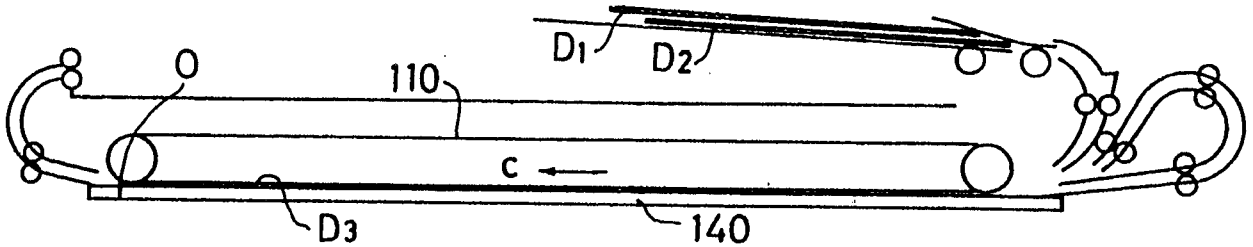
FIGS. 14(*a*)–14(*d*) are explanatory views showing how an original is transported in the ADF in the second embodiment of the present invention under a double-faced two-in-one mode, continuation of FIG. 13.
Figure 14B:
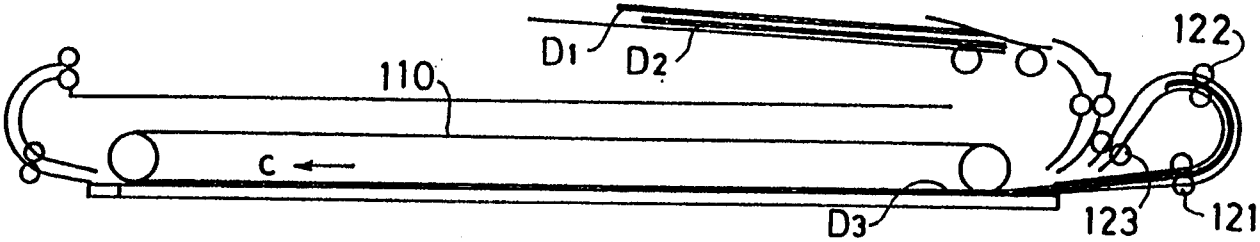
Figure 14C:
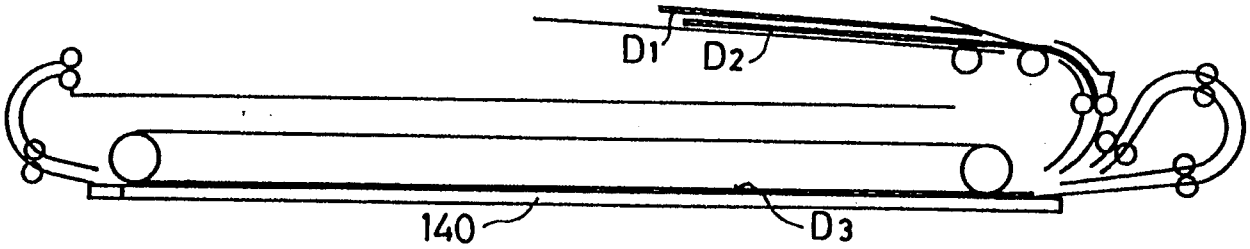
Figure 14D:
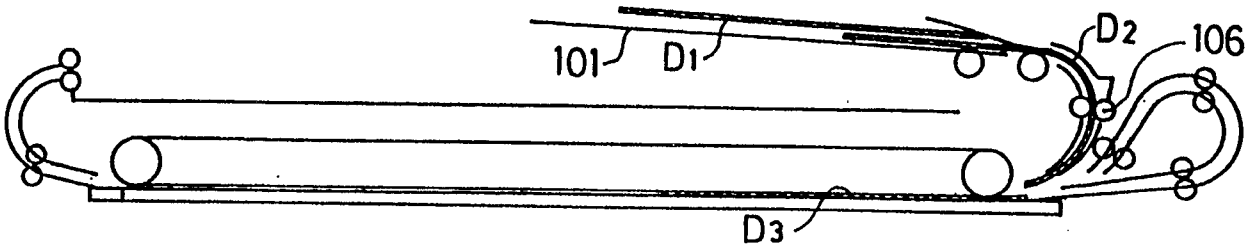

After the completion of image exposure process for the reverse side of the original D3, the original D3 is inverted again, and then discharged onto the tray 69 (refer to FIG. 11(*b*)).

In the case if the length of an original exceeds 210 mm, a double-faced normal mode is executed. In this case, the pickup roller 54 is brought down when the rear end of a first original D1 is detected by the register sensor SE12. At a time point that pulses n7 is counted from the encoder E3 of the main motor M3 after the leading end of the first original D1 is detected by the timing sensor SE14, the motor M3 is turned off, and at the same time, the electromagnetic brake BRK2 is turned on to stop the transport belt 60 whereby the first original is transported to an exposure position to have its leading end to be positioned at an exposure standard position 0. Then, an image exposure process for a first page (the surface of original D1) is conducted to reproduce an image of the first page on a copy sheet. Thereafter, the original D1 is inverted, and second page (the reverse side of the original D1) is set at the exposure position to perform an image exposure process in order to reproduce an image of the second page on a copy sheet. Further, the original D1 is inverted and then discharged onto the tray 69.

A preliminary feed process for a second original D2 is completed before an image exposure process for the second page is finished, and image forming process for third and fourth pages are successively performed followed by a preliminary feed process for a third original D3 and image forming process for fifth and sixth pages.

Second Embodiment; Refer to FIGS. 12 through 19 and FIG. 21

In an ADF100 which is shown as a second embodiment of the present invention, originals stacked on a tray 101 are fed one after another from an original placed undermost to forward the original from a feed path 105 onto a platen glass 140. The original is transported by a transport belt 110 in a direction of an arrow c, and is stopped when the leading end of the original is positioned at an exposure standard point 0. The exposure standard point 0 is set at a boundary between the left side in the figure of the platen glass 140 and an original scale 141. After the completion of an image exposure process, the original is discharged onto a tray 135 through a discharge path 130.

At the leading end of the tray 101, there is provided a pickup roller 102. A separating mechanism comprised of a regular separating roller 103 and a friction pad 104 is arranged at a downstream side of the pickup roller 102. In the feed path 105, a pair of register rollers 106 are provided. An inverting path 120 is provided with a pair of rollers 121, 122 and 123, to return an original once transported onto the platen glass 140 to the platen glass 140 again after the original is switched back and inverted. The transport belt 110 is endlessly stretched between a driving roller 111 and a driven roller 112, and is rotationally driven either regularly or reversely in a regular direction or reverse direction of the arrow c. The discharge path 130 is provided with a pair of rollers 131 and 132 to discharge an original onto a tray 135 from the pair of rollers 132.

Description will be made hereinafter on a transport procedure which is conducted in the ADF100 for a double-faced original under two-in-one mode.

A transport procedure for three sheets of double-faced originals D1, D2 and D3 placed in page sequence will be described.

The originals D1, D2 and D3 are stacked on the tray 101 with first page (the surface of original D1) faced upward (refer to FIG. 13(*a*)). Upon the start of a copying operation, accompanied with the rotation of the pickup roller 102 and regular separating roller 103, a last original (third original) D3 is fed to the pair of register rollers 106, and the leading end of the original is brought in contact with a nip section of the pair of rollers 106 for a registering process (refer to FIG. 13(*b*)).

Then, the original D3 is transported onto the platen glass 140 with the rotation of the pair of register rollers 106 and transport belt 110 (refer to FIG. 13(*c*)). The transport belt 110 is then rotated reversely, and at the same time, the pair of reversing rollers 121, 122 and 123 are rotated (refer to FIG. 13(*d*)) whereby the original D3 is inverted, and when the rear end of the original is completely entered into the inverting path 120, the rotation of the transport belt 110 is switched over to a regular rotation to transport the original D3 until the leading end of the original reaches the exposure standard point 0 (refer to FIG. 14(*a*)). At this stage, sixth page (the reverse side of original D3) faces the platen glass 140 at the exposure position, and with an image exposure process, an image ⑥ of the sixth page is reproduced on a first copy sheet S1 (refer to FIG. 21). The image ⑥ of the sixth page is formed on the left half side of the copy sheet S1, and the right half side is left blank.

After the completion of image exposure for the reverse side of the original D3, the transport belt 110 is reversely rotated to return the original to the reverse direction of the arrow c, and by rotating the pair of reversing rollers 121, 122 and 123, the original D3 is inverted (refer to FIG. 14(*b*)). When the original D3 is inverted and returned onto the platen glass 140 with fifth page faced downward (refer to FIG. 14(*c*)), a second original D2 is fed from the tray 101. After the original D2 is registered at the pair of register rollers 106, the original D2 is transported to a position where the leading end of the original D2 corresponds with the rear end of the preceding original D3 (standard waiting point T), and is stopped thereat (refer to FIG. 14(*d*)).

Figures 15A, 15B, 15C, 15D:
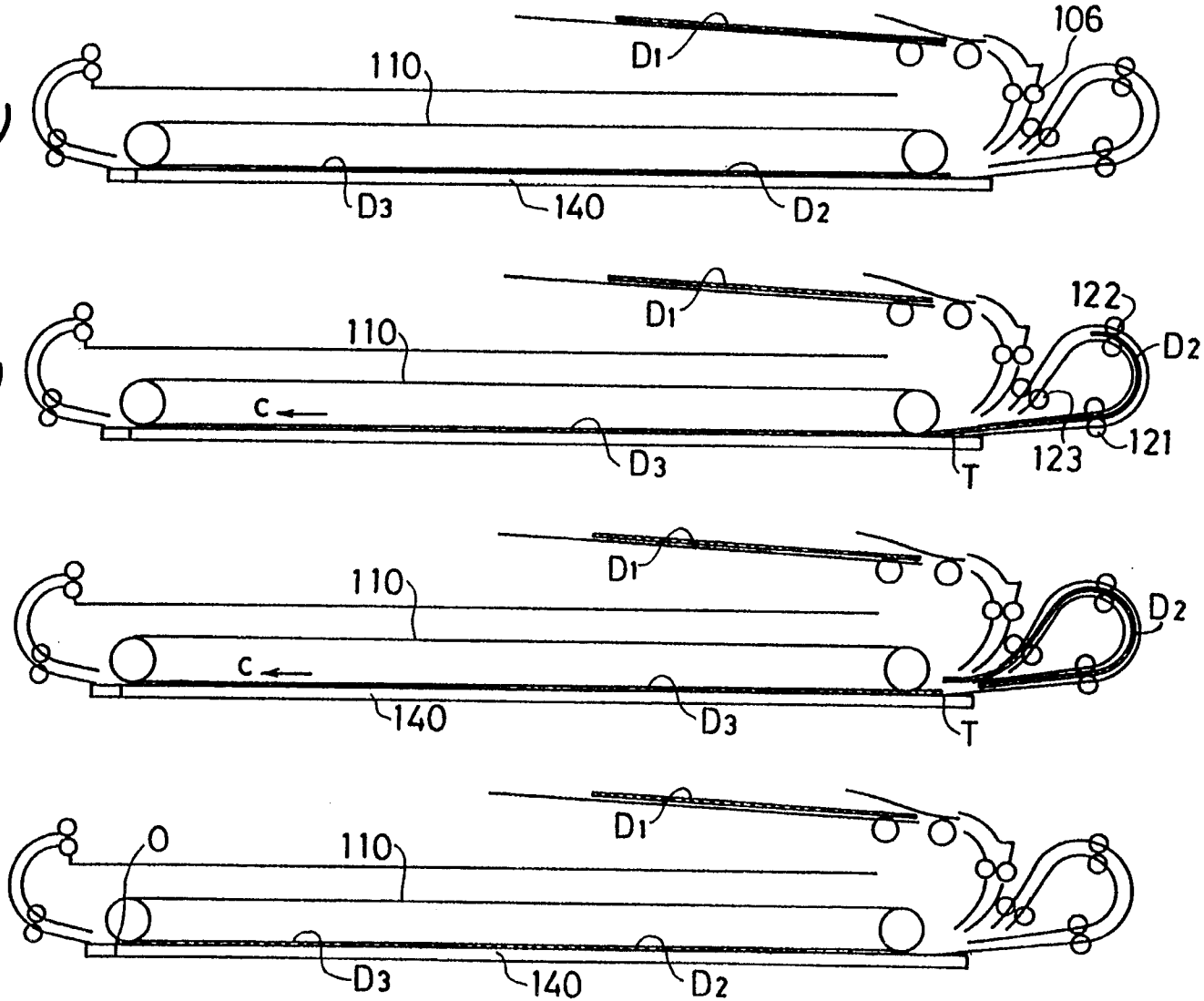
FIGS. 15(*a*)–15(*d*) are explanatory views showing how an original is transported in the ADF in the second embodiment of the present invention under a double-sided two-in-one mode, continuation of FIG. 14.
Figure 21:
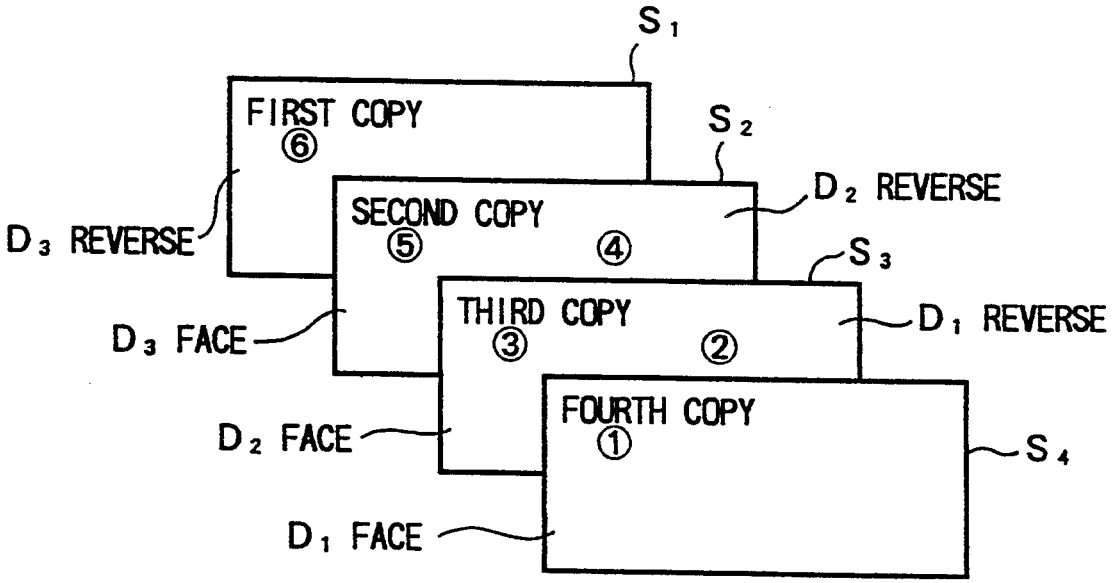
FIG. 21 is an explanatory view showing copy sheets reproduced under a double-faced two-in one mode in the second embodiment of the present invention.

Then, the transport belt 110 and the pair of register rollers 106 are rotated to transport the original D2 onto the platen glass 140 (refer to FIG. 15(*a*)). Thereafter, the transport belt 110 is reversely rotated while rotating the pair of reverse rollers 121, 122 and 123, and when the rear end of the original D3 is reached at the standard waiting point T, the reverse rotation of the transport belt 110 is stopped (refer to FIG. 15(*b*)). The original D2 is kept its inverting action, and when the leading end of the original is reached at the standard waiting point T (refer to FIG. 15(*c*)), in other words, when the end portions of the originals D3 and D2 correspond each other, the transport belt 110 is rotationally driven to simultaneously transport the originals D3 and D2 onto the platen glass 140 in the direction of the arrow c, and when the leading end of the original D3 is reached at the exposure standard point 0, the rotation of the transport belt 110 is stopped whereby the originals D3 and D2 are set at exposure position without having any gap therebetween (refer to FIG. 15(*d*)). At this time, fifth page (the surface of original D3) and fourth page (the reverse side of original D2) are placed facing the platen glass 140, and after an image exposure process, images ⑤ and ④ of the fifth page and fourth page are reproduced on a second copy sheet S2 as illustrated in FIG. 21.

Figures 16A, 16B, 16C, 16D:
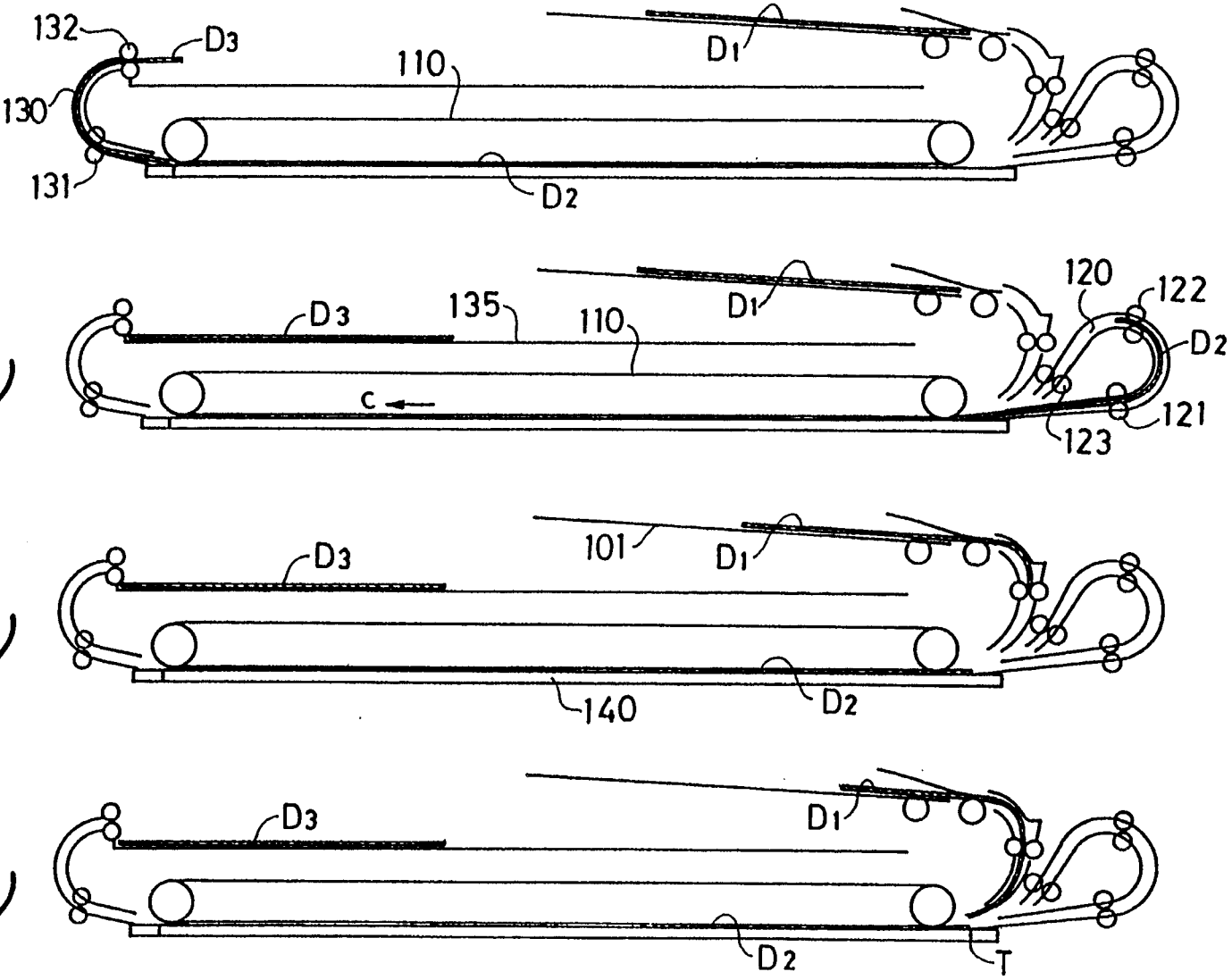
FIGS. 16(*a*)–16(*d*) are explanatory views showing how an original is transported in the ADF in the second embodiment of the present invention under a double-faced two-in-one mode, continuation of FIG. 15.
Figure 17A:
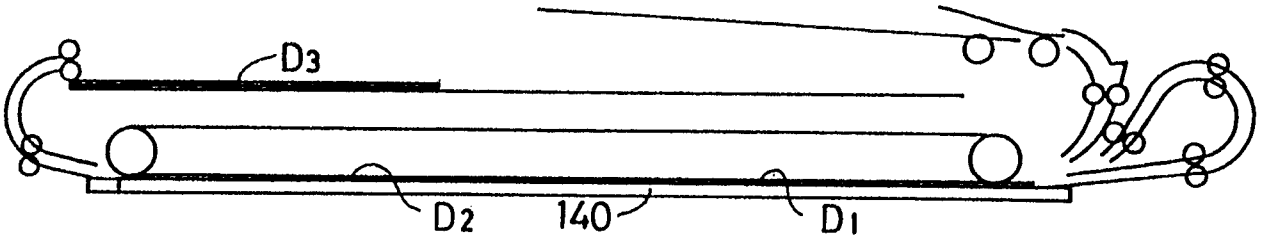
FIGS. 17(*a*)–17(*d*) are explanatory views showing how an original is transported in the ADF in the second embodiment of the present invention under a double-faced two-in-one mode, continuation of FIG. 16.
Figure 17B:
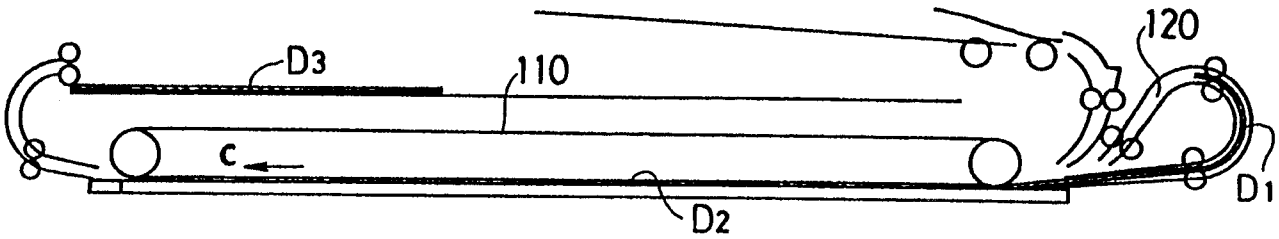
Figure 17C:
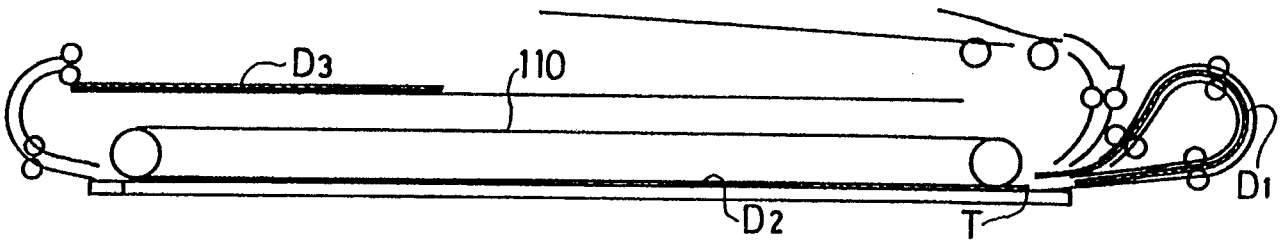
Figure 17D:
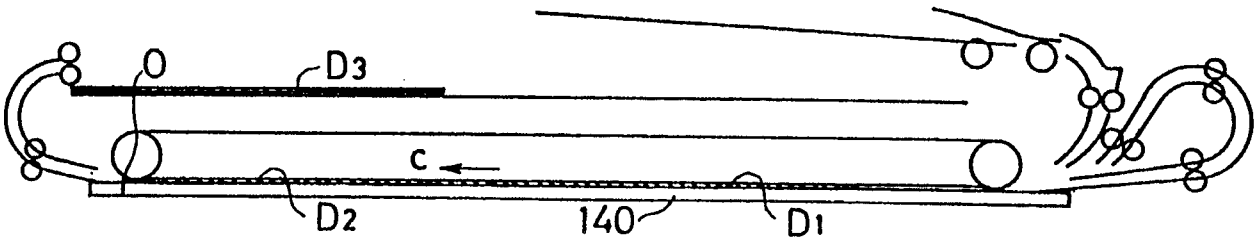
Figure 18A:
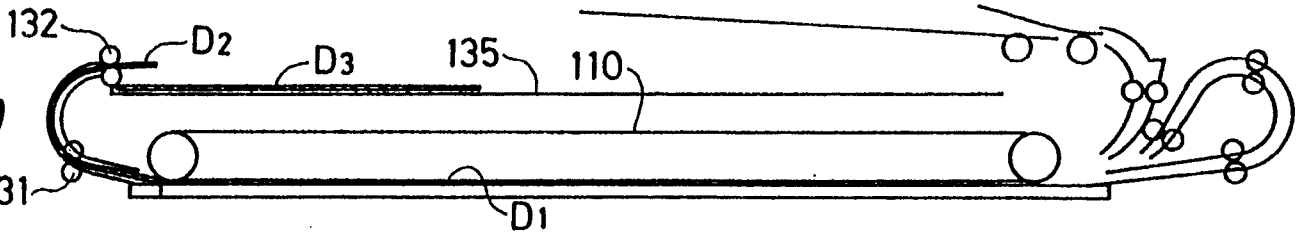
FIGS. 18(*a*)–18(*d*) are explanatory views showing how an original is transported in the ADF in the second embodiment of the present invention under a double-faced two-in-one mode, continuation of FIG. 17.
Figure 18B:
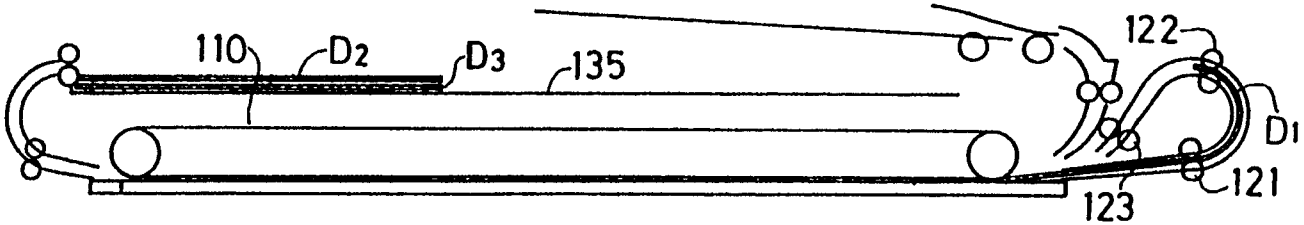
Figure 18C:
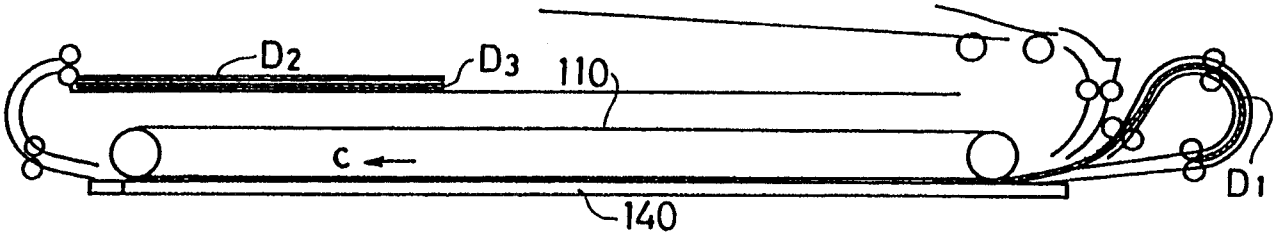
Figure 18D:
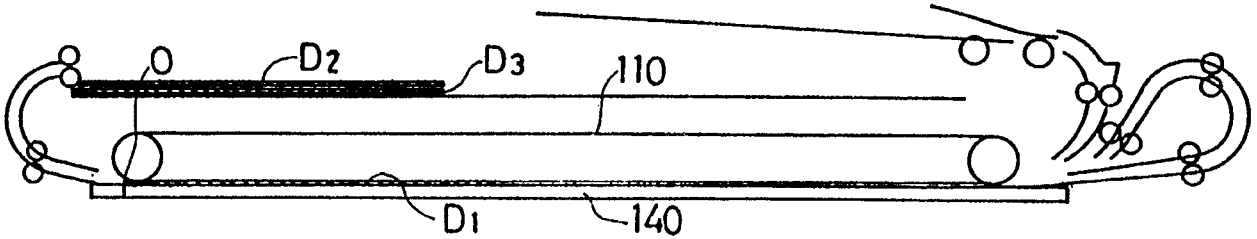
Figure 19A:
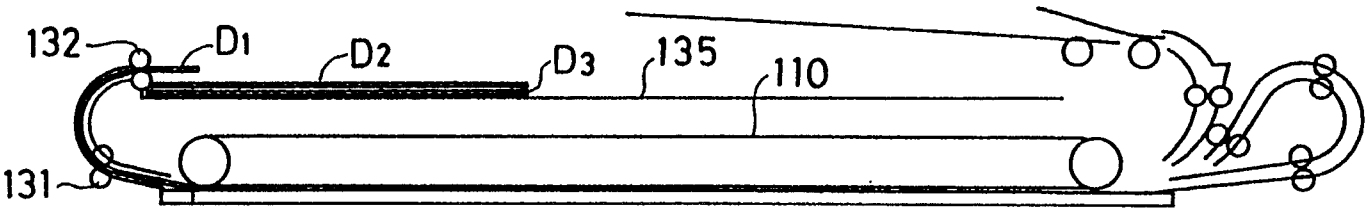
FIGS. 19(*a*)–19(*b*) are explanatory views showing how an original is transported in the ADF in the second embodiment of the present invention under a double-sided two-in-one mode, continuation of FIG. 18.
Figure 19B:
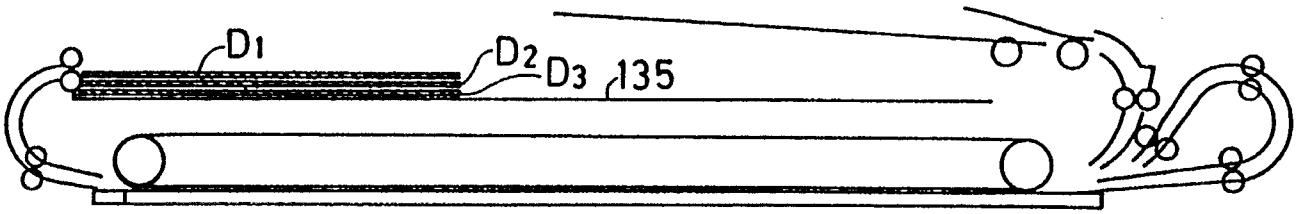

Then, the transport belt 110 and the pair of discharge rollers 131, 132 are rotated whereby a third original D3 is transported to the discharge path 130 (refer to FIG. 16(*a*)). After the rear end of the original D3 has passed through the transport belt 110, the transport belt 110 is switched over to a reverse rotation. The original D3 is kept its discharging movement, and discharged onto the tray 135 with sixth page faced upward. The original D2 is returned to the opposite direction of the arrow c, and is sent into the inverting path 120 with the rotation of the pair of reversing rollers 121, 122 and 123 (refer to FIG 16(*b*)). The original D2 is inverted, and when the original is returned onto the platen glass 140 with third page faced downward (refer to FIG. 16(*c*)), the first original D1 is fed from the tray 101. A feeding process for a first original D1 is the same as the process performed for the original D2. The original D1 is fed to a position where it corresponds to the rear end of the preceding original D2 (standard waiting point T) (refer to FIG. 16(*d*)).

The original D1 is then transported onto the platen glass 140 (refer to FIG. 17(*a*)), and with a reverse rotation of the transport belt 110, the original D1 is forwarded into the inverting path 120, and is inverted (refer to FIG. 17(*b*)). The reverse rotation of the transport belt 110 is stopped when the rear end of the original D2 is reached at the standard waiting point T, and the inversion of the original D1 is stopped when the leading end of the original is reached at the standard waiting point T (refer to FIG. 17(*c*)). Then, the originals D2 and D1 are simultaneously transported in the direction of the arrow c on the platen glass 140, and when the leading end of the original D2 is reached the exposure standard point 0, the transport process is stopped whereby the originals D2 and D1 are set at an exposure position without having any gap therebetween (refer to FIG. 17(*d*)). At this stage, third page (the surface of original D2) and second page (the reverse side of original D1) are placed facing the platen glass 140, and an image exposure process is conducted. Images ③ and ② of the third page and second page are thus reproduced on a third copy sheet S3 as illustrated in FIG. 21.

Thereafter, the transport belt 110 and the pair of discharge rollers 131, 132 are rotated to discharge the second original D2 onto the tray 135 with fourth page faced upward (refer to FIGS. 18(*a*) and 18(*b*)). After the rear end of the original D2 has passed through the transport belt 110, the transport belt 110 is switched over to a reverse rotation to transport the first original D1 in the opposite direction to the arrow c, and by rotating the pair of reversing rollers 121, 122, 123, the original D1 is inverted (refer to FIG. 18(*b*)). Then, with regular rotation of the transport belt 110, the original is transported on the platen glass 140 with first page faced downward, and when the leading end of the original is reached the exposure standard point 0, the transport of the original D1 is stopped (refer to FIGS. 18(*c*)). An image exposure process is then conducted, and an image ① of first page is reproduced on the left half side of a fourth copy sheet S4 leaving the right half side blank as illustrated in FIG. 21. Then, the transport belt 110 and the pair of discharge rollers 131, 132 are rotated to discharge the original D1 onto the tray 135 (refer to FIGS. 19(*a*) and 19(*b*)).

The automatic document feeder of the present invention is not limited to the aforementioned embodiments, and they may variably be changed within the scope of the invention. A variety of changes and modifications may be adapted to the pickup mechanism, separating mechanism, inverting mechanism and discharging mechanism of the automatic document feeding apparatus of the present invention.

As shown in FIGS. 20 and 21, when only an image of one page is formed (copy sheets S1, S4), the image is reproduced on the left half side of a copy sheet, and the right half side is left blank. However, when it is required to change such an arrangement, it may be arranged to stop an original when the leading end of the original has reached about a center of the platen glass 29 or 140 to conduct an image exposure process thereat, not transporting the original until the leading end of the original reaches the exposure standard point 0. In this case, an image is reproduced on the right half side of a copy sheet and the left half side is left blank.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A document feeding apparatus, comprising:

forwarding means for successively forwarding N sheets of originals accommodated in a state of stacked layer one sheet by one sheet, wherein original images in page sequence are successively formed on both sides of the N sheets of originals, and on the surface of a nth sheet of original, an original image of $2n-1$ page, and on the reverse side thereof, an original image of 2n page are formed respectively; and transport means for receiving a series of nth sheet and $n+1$th sheet of originals forwarded by the forwarding means to transport said sheets in a predetermined transport direction and stopping the nth and n+1th sheets of originals side by side at a predetermined position, the transport means being provided with inverting means for inverting the surface and reverse side of an original whereby either one of the two sheets of originals is inverted, and original images of the 2n page and 2n+1 page are stopped side by side at a predetermined position, where N and n are natural numbers.

2. A document feeding apparatus as claimed in claim 1, wherein said transport means stops two sheets of originals side by side at a predetermined position in a document feeding direction.

3. A document feeding apparatus as claimed in claim 1, wherein said forwarding means forwards a nth sheet of original first, and then forwards a n+1th sheet of original.

4. A document feeding apparatus as claimed in claim 1, wherein said forwarding means forwards a n+1th sheet of original first, and then forwards a nth sheet of original.

5. A document feeding apparatus, comprising:

forwarding means for successively forwarding a plurality of originals accommodated in a state of stacked layer one sheet by one sheet, wherein original images in page sequence are successively formed on both sides of said plurality of originals; and transport means for receiving a series of two sheets of originals forwarded by said forwarding means to transport said two sheets of originals in a predetermined transport direction and stopping the two sheets of originals side by side at a predetermined position, the transport means being provided with inverting means for inverting the surface and reverse sides of an original to invert either one of the two sheets of originals whereby the surface of either one of the two sheets of originals and the reverse side of another sheet of original are stopped side by side.

6. A document feeding apparatus as claimed in claim 5, wherein said transport means stops two sheets of originals side by side at a predetermined position in a document feeding direction.

7. A copying apparatus, comprising:

forwarding means for successively forwarding N sheets of originals accommodated in a state of stacked layer one sheet by one sheet, wherein original images in page sequence are successively formed on the surface and reverse side of said N sheets of originals, and on the surface of nth sheet of original, an original image of 2n−1 page, and on the reverse side thereof, an original image of 2n page are formed respectively;

a platen for placing two sheets of originals side by side;

transport means for receiving a series of nth and n+1th sheets of originals forwarded by said forwarding means to transport said originals in a predetermined transport direction, and stopping and placing nth and n+1th sheets of originals side by side on said platen, the transport means being provided with inverting means for inverting the surface and reverse side of an original to invert either one of the two sheets of originals, and original images of 2n page and 2n+1 page are placed side by side on the platen; and copying means for scanning original images of the 2n and 2n+1 pages placed on the platen and coping said original images on one sheet, where N and n are natural numbers.

8. A copying apparatus as claimed in claim 7, wherein said transport means stops two sheets of originals side by side on the platen in a document feeding direction.

9. A document feeding apparatus as claimed in claim 7, wherein said forwarding means forwards nth sheet of original first, and then forwards n+1h sheet of original.

10. A document feeding apparatus as claimed in claim 7, wherein said forwarding means forwards n+1th sheet of original first, and then forwards nth sheet of original.

11. A document feeding apparatus, comprising:

forwarding means for successively forwarding a plurality sheets of originals accommodated in a state of stacked layer one sheet by one sheet, wherein original images in page sequence are successively formed on the surface and reverse side of the plurality of sheets of originals;

a platen for placing two sheets of originals side by side;

transport means for receiving a series of two sheets of originals forwarded by said forwarding means to transport the sheets of originals in a predetermined direction, and stopping said two sheets of originals and placing them side by side on said platen, the transport means being provided with inverting means for inverting the surface and reverse side of an original to invert either one of the two sheets of originals, and the surface of either one of the original and the reverse side of another original are placed side by side; and copying means for scanning the surface of either one of said two sheets of originals and the reverse side of another original placed on the platen, and copying the originals on one sheet.

12. A document feeding apparatus as claimed in claim 11, wherein said transport means stops two sheets of originals side by side at a predetermined position in a document feeding direction.

13. A method of copying a plurality of originals, comprising the steps of:

a first step for transporting a first sheet of an original onto a platen to copy a first side of the original;

a second step for inverting an original whose first side has been copied, and transporting a succeeding original onto a platen wherein a second side of a preceding original and a first side of a succeeding original are copied; and a third step for repeating said second step.

14. A copying method as claimed in claim 13, further comprising the steps of:

a fourth step for inverting a preceding original whose first side has been copied, and transporting a final original onto the platen to copy a second side of the preceding original and a first side of the final original, and a fifth step for inverting the final original to copy a second side of the original.

* * * * *